US009911406B2

(12) United States Patent
Butler et al.

(10) Patent No.: US 9,911,406 B2
(45) Date of Patent: Mar. 6, 2018

(54) METHOD AND SYSTEM FOR LARGE SCALE AUDIO SYSTEM

(71) Applicants: Nathan Butler, Sterling, MA (US); Steven Desrosiers, Woonsocket, RI (US); Matthew Joseph Dube, Westborough, MA (US); Geoffrey Peter McKinnon, Woonsocket, RI (US); Jeffrey A. Rocha, Paxton, MA (US)

(72) Inventors: Nathan Butler, Sterling, MA (US); Steven Desrosiers, Woonsocket, RI (US); Matthew Joseph Dube, Westborough, MA (US); Geoffrey Peter McKinnon, Woonsocket, RI (US); Jeffrey A. Rocha, Paxton, MA (US)

(73) Assignee: LOUD AUDIO, LLC, Woodinville, WA (US)

( * ) Notice: Subject to any disclaimer, the term of this patent is extended or adjusted under 35 U.S.C. 154(b) by 0 days.

(21) Appl. No.: 14/683,009

(22) Filed: Apr. 9, 2015

(65) Prior Publication Data

US 2015/0289050 A1 Oct. 8, 2015

Related U.S. Application Data

(63) Continuation-in-part of application No. 14/489,340, filed on Sep. 17, 2014, now Pat. No. 9,215,524, which
(Continued)

(51) Int. Cl.
*H04R 25/00* (2006.01)
*G10K 11/22* (2006.01)
(Continued)

(52) U.S. Cl.
CPC ..... *G10K 11/22* (2013.01); *G10K 11/26* (2013.01); *H04R 1/30* (2013.01); *H04R 1/403* (2013.01); *H04R 1/345* (2013.01); *H04R 2201/34* (2013.01)

(58) Field of Classification Search
CPC . H04R 1/403; H04R 3/12; H04R 1/26; H04R 2201/401; H04R 2430/20; H04R 2203/12; G10K 11/26; H04S 3/00
(Continued)

(56) References Cited

U.S. PATENT DOCUMENTS 1,752,526 A 4/1930 Hinckley
2,058,132 A 10/1936 Cirelli
(Continued)

FOREIGN PATENT DOCUMENTS

GB 2 230 682 A 10/1990
JP 63-236498 A 10/1988
JP 2009-65609 A 3/2009

OTHER PUBLICATIONS

"Airline LA12: 3-Way Symmetrical High Output Line Array System," Product Data, Apr. 2012, Coda Audio GmbH, Hannover, Germany, <http://www.codaaudio.com/products/line-arrays/airline-la-series/airline-la12/airline-la12 -overview/>, p. 5.
(Continued)

*Primary Examiner* — Davetta W Goins
*Assistant Examiner* — Phylesha Dabney
(74) *Attorney, Agent, or Firm* — Christensen O'Connor Johnson Kindness PLLC

(57) ABSTRACT

Audio loudspeaker 100 can be arranged in various vertical arrays, such as 102 or 104. Each loudspeaker 100 includes a generally trapezoidal-shaped housing 120 composed of two forwardly projecting lobe sections 122. A pair of low-frequency cone transducers 130 are housed in the lobe
(Continued)

sections 122. A vertically arranged set 132 of high-frequency compression drivers are positioned centrally in the housing to project in the forward direction. Three mid-frequency cone transducers 134 are vertically arranged along opposite sides of the high frequency drivers 132. Each of the low-, mid-, and high-frequency transducers are individually powered and controlled by a separate DSP channel.

20 Claims, 31 Drawing Sheets

Related U.S. Application Data is a continuation-in-part of application No. 13/832,817, filed on Mar. 15, 2013, now Pat. No. 9,219,954.

(60) Provisional application No. 61/977,602, filed on Apr. 9, 2014.

(51) Int. Cl.

| | |
|---|---|
| ***G10K 11/26*** | (2006.01) |
| ***H04R 1/30*** | (2006.01) |
| ***H04R 1/40*** | (2006.01) |
| *H04R 1/34* | (2006.01) |

(58) Field of Classification Search
USPC ..... 381/387, 300–303, 58–59, 82, 103
See application file for complete search history.

(56) References Cited

U.S. PATENT DOCUMENTS

| | | | | |
|---|---|---|---|---|
| 4,344,504 | A | 8/1982 | Howze | |
| 4,629,029 | A | 12/1986 | Gunness | |
| 4,923,031 | A | 5/1990 | Carlson | |
| 5,070,530 | A | 12/1991 | Grodinsky | |
| 5,519,572 | A | 5/1996 | Luo | |
| 5,715,322 | A | 2/1998 | Yoshioka | |
| 5,996,728 | A * | 12/1999 | Stark | H04R 1/028 181/144 |
| 6,035,051 | A | 3/2000 | Sato | |
| 6,112,847 | A | 9/2000 | Lehman | |
| 6,118,883 | A | 9/2000 | Rocha | |
| 6,385,322 | B1 * | 5/2002 | Mietling | H04R 3/04 381/59 |
| 6,393,131 | B1 | 5/2002 | Rexroat | |
| 6,394,223 | B1 | 5/2002 | Lehman | |
| 6,668,969 | B2 | 12/2003 | Meyer | |
| 6,712,177 | B2 | 3/2004 | Ureda | |
| D500,025 | S | 12/2004 | Vincenot | |
| D500,306 | S | 12/2004 | Noselli | |
| 7,392,880 | B2 | 7/2008 | Buck | |
| 7,454,029 | B2 | 11/2008 | Andrews | |
| 7,590,257 | B1 | 9/2009 | Blanchard | |
| 8,199,953 | B2 | 6/2012 | Buccafusca | |
| 8,224,001 | B1 | 7/2012 | Waller | |
| 8,275,160 | B2 * | 9/2012 | Kushida | H04R 3/12 381/17 |
| 2002/0038740 | A1 | 4/2002 | Ureda | |
| 2003/0132056 | A1 | 7/2003 | Meyer | |
| 2004/0218773 | A1 | 11/2004 | Andrews | |
| 2006/0169530 | A1 | 8/2006 | Noselli | |
| 2011/0069856 | A1 | 3/2011 | Blore et al. | |
| 2011/0222698 | A1 | 9/2011 | Asao et al. | |
| 2011/0305347 | A1 | 12/2011 | Wurm | |
| 2012/0213387 | A1 | 8/2012 | Blore | |

OTHER PUBLICATIONS

"Cohedra™ CDR 208 S/T" (Product Information), HK Audio, Germany, <www.hkaudio.corn/products.php?id=205>, 2011, 5 pages.

"DSA250i: 2-Way Full-Range Digitally Steerable Array," Part No. RD0383 (A) DSA250i SPEC (Specifications), Eastern Acoustic Works, Whitinsville, Mass., <www.eaw.com/docs/2_legacy.../DSA250i/DSA250i_SPECS_revA.pdf>, Feb. 2007, 5 pages.

"Flashline : TFS-900H: Four-Way Line Array Module" (Product Information), Oct. 2011, Turbosound, Partridge Green UK, <http://www.turbosound.com/docs/products/TFS-900H.shtml>, 2 pages.

"GTO Tech Specs" (Product Information), Outline s.r.l., Flero, Italy, <http://89.96.202.198/GTO/index_eng_3.htm>, 12 pages.

International Search Report and Written Opinion mailed Jun. 6, 2014, issued in corresponding International Application No. PCT/US2014/021959, filed Mar. 7, 2014, 9 pages.

"KF740: 3-Way Full Range Loudspeaker," Part No. RD0510 (A) KF740 SPEC (Specifications), Eastern Acoustic Works, Whitinsville, Mass., <http://www.eaw.com/KF740>, Nov. 2009, 7 pages.

"KF760," Part No. KF760/0002962/2 (Specifications), Eastern Acoustic Works, Whitinsville, Mass., <http://www.eaw.com/KF760>, Apr. 2002, 3 pages.

"KF910," Part No. KF910/888056(A)/2 (Specifications), Eastern Acoustic Works, Whitinsville, Mass., <http://www.manualslib.com/download/41874/Eaw-Kf910.html>, Jan. 29, 1999, 3 pages.

"KIVA Modular WST® Line Source," Product Spec Sheet KIVA_SP_EN_04-1/06-10, L-Acoustics, Marcoussis, France, <http://www.l-acoustics.com/products-kiva-31.html>, Jun. 2010, 1 page.

"LS432," Publication No. LS432-888138(A)/2 (Technical Specifications ), Eastern Acoustic Works, Whitinsville, Mass., <eshop.prodance.cz/Files/LS432_POLAR.pdf>, Feb. 1, 1999, 21 pages.

"LS832," Publication No. LS832-888139 (A)/2 (Technical Specifications), Eastern Acoustic Works, Whitinsville, Mass., <eshop.prodance.cz/Files/LS832_POLAR.pdf>, 21 pages.

"MILO™: High-Power Curvilinear Array Loudspeaker," Product No. 04.132.096.01 C, Datasheet, Meyer Sound Laboratories Inc., Berkeley, Calif, <http://www.meyersound.com/products/mseries/milo/>, 2003, 4 pages.

"MLA Compact™: Multi-Cellular Loudspeaker Array" (Product Information), Martin Audio, London, <http://www.martinaudio-mla.com/downloads/brochuredownloads>, 10 pages.

"MLA™Multi-Cellular Loudspeaker Array: MLA System Dual Hybrid® Bass Section" (Product Information), Martin Audio, London, <http://www.martinaudio-mla.com/downloads/brochuredownloads>, 2010, p. 15.

"NTL720: 3-Way Self-Powered, 110° x 12°," Part No. NTL720 SPEC (Specifications), Eastern Acoustic Works, Whitinsville, Mass., <http://www.eaw.com/NTL720>, Nov. 2007, 3 pages.

"PacRim Line Array PA Speaker System From Turnaround360" (Product Information), PacRim, UK, <http://pacrim.co.uk/L5-longthrow.html>, 6 pages.

"VerTec © Series, Subcompact Models," Publication No. CAT VTSUB-25 (Product Information), JBL by Harman, Northridge, Calif., <http://www.jblpro.com/catalog/support/getfile.aspx?doctype=3&docid=1453>, Mar. 2011, 6 pages.

"VTX V25: RBI Radiation Boundary Integrator® and VTX Waveguide," Publication No. CAT VTX-25 (Product Information), JBL by Harman, Northridge, Calif., <http://www.jblpro.com/products/tour/vtx/specs.html>, Sep. 2012, 12 pages.

Communication pursuant to Article 94(3) EPC dated Jun. 28, 2016, issued in corresponding Application No. EP 14 712 166.9, filed Mar. 7, 2014, 6 pages.

* cited by examiner

METHOD AND SYSTEM FOR LARGE SCALE AUDIO SYSTEM

CROSS-REFERENCES TO RELATED APPLICATIONS

This application is a continuation-in-part of U.S. application Ser. No. 14/489,340, filed Sep. 17, 2014, which is a continuation-in-part of U.S. application Ser. No. 13/832,817, filed Mar. 15, 2013, and this application also claims the benefit of U.S. Provisional Application No. 61/977,602, filed Apr. 9, 2014, all of the disclosures of which are hereby incorporated by reference herein in their entirety.

BACKGROUND

Typically, sound systems for live concert touring are owned by a professional sound provider and travel in one of many tractor/trailer trucks with all the band's production equipment. This can include lighting, video, staging and the band's instruments. A variety of speaker types is typically carried on the tour to accommodate the variety of seating arrangements various venues may provide.

Typically, a large line array is used to cover the main audience area and the farthest areas of an arena or stadium. Smaller line arrays are used to cover the outer sides and center of the audience area. Additional speakers are then also used on stage to cover the closest audience members. There are typically 2 to 7 or more separate loudspeaker arrays brought in and flown (installed) on the day of the show. As most systems are symmetric on the left and right, 1 to 4 or more arrays must be designed to fit their respective coverage areas.

With existing line array loudspeakers each box in the array can be set to a number of different angles relative to the adjacent box; smaller angles increase sound pressure level (SPL), larger angles increase vertical coverage. To get a general idea of the number of speakers required and location for array, acoustic modeling software is used to roughly "draw" the venue prior to the show. This initial look provides a starting point for future modeling, but not the actual angles or orientations of the speakers that need to be implemented on show day.

To fine-tune the speaker angles for the actual performance, a system engineer will arrive early in the morning at the venue to measure the dimensions of the room (typically with a laser range finder), and verify the actual suspension locations and trim height limitations. The venue configuration will then be modified in the modeling software and appropriate array angles and trim heights are chosen. This work must be completed before the loudspeakers can be flown (installed) in the venue.

The loudspeakers are then flown in the venue. Flying each array is a labor-intensive process. Large format loudspeakers typically weigh in excess of 200 lbs. Inter-cabinet angles must be set between each cabinet, typically at more than one point per cabinet. If angles are set incorrectly or the trim height is incorrect, the system could have non-ideal coverage, or worse, not cover the entire audience. Once all the arrays are flown, connected and powered, the system technician will take acoustical measurements of the system to see how the performance matches their acoustic model. If performance is very poor and time permits, an array might be brought down and reconfigured. However, if time does not permit, typically only system equalization and array alignment delay can be adjusted to improve performance. In extreme cases at least some loudspeakers are unplugged to modify coverage.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A loudspeaker system includes a plurality of adaptive loudspeakers, each having a housing, a plurality of transducers within the housing, with each of the transducers being individually powered and controlled. In addition, a digital signal processor channel is provided for each transducer to control the output, including the vertical and/or horizontal directionality of each transducer. An electronic network interconnects the digital signal processing channels with each other. A control system is provided to monitor and control the operation and performance of the transducers individually. The control system includes a computer processor connected to the networked digital signal processing channels and is capable of calculating the loudspeaker output acoustic lobe formation parameters. The control system controls the operation of the transducers based on the calculated loudspeaker output lobe formation parameters.

The control system controls the digital signal processor channels to direct the acoustic output from the loudspeaker components in desired vertical and/or horizontal directions. In this regard, the control system controls at least one of the gain, delay, and response of each transducer in the loudspeaker, thereby to selectively direct the acoustic output from the loudspeaker in a desired vertical direction to achieve a desired coverage of a venue in which the loudspeaker is located, as well as to selectively direct the acoustic output of the loudspeaker in a desired horizontal direction.

Each of the loudspeakers includes a self-testing program incorporated into the circuitry of the loudspeaker, whereby to operably verify that the components of the loudspeaker are operating properly. The loudspeaker system further includes a plurality of high-frequency transducers in the range of about 1500 Hz to 20 kHz, mid-range transducers in the range of approximately 200 Hz to 2 kHz, and low-frequency transducers in the range of about 30 Hz to 300 Hz.

The individual loudspeakers may be arranged in a vertical array, with the vertical array in substantially a straight vertical line. Also, vertical arrays of loudspeakers may be positioned side-by-side to each other to achieve a desired horizontal coverage or scope. The loudspeakers are also substantially identical in construction, including the same transducer configuration and the same number and type of transducers.

Proximity sensors are disposed on the loudspeaker to enable the control system to determine the identity and position of each loudspeaker in an array. Such proximity sensors may transmit signals in the infrared frequency range, or alternatively ultrasonic or radar-type proximity sensors may be utilized.

A tilt sensor is positioned within each of the loudspeaker cabinets, thereby to determine the tilt of each loudspeaker cabinet. The output of the tilt sensors are actively directed to the control system.

As a further aspect of the present disclosure, the self-testing program is incorporated into loudspeakers of the above configuration or into loudspeakers of other configurations. The self-test program is operable to verify that the transducers and other components of each loudspeaker are operating properly.

In accordance with a further aspect of the present disclosure, the control system for the loudspeakers of the above configuration, or loudspeakers of other configurations, can function to verify the specific location of each loudspeaker with respect to the location in the venue in question. The control system generates acoustical impulses from transducers positioned at different locations to trilaterally locate the microphone and thereby determine the distance and direction of the microphone relative to the transducers which generated the acoustical impulses. This helps to verify the configuration of the venue in question.

As a further aspect of the present disclosure, proximity sensors may be utilized in conjunction with the loudspeakers described above, or with loudspeakers of other configurations. Such proximity sensors are capable of determining the position of each loudspeaker based on the output signals from the proximity sensors. Such proximity sensors may consist of infrared proximity sensors, ultrasonic proximity sensors, or radar proximity sensors.

The present disclosure also includes a method for providing sound to a venue, including creating a model of the configuration of the venue, and assembling a plurality of loudspeakers in stacked relationship, and positioning the stacked loudspeakers so that the loudspeakers are disposed in a substantially vertical array. Each of said loudspeakers includes transducers and/or drivers, wherein each transducer/driver is operated by a digital signal processor channel. Based on the modeled venue configuration, the stacked loudspeaker arrays are positioned at one or more locations at the venue. Each of the transducers or drivers is operated individually by a control system that networks all the digital processor channels together and also networks the loudspeakers together. Each of the transducers/drivers is tested and the parameters for each loudspeaker is individually specified. In this regard, the gain, delay, and/or response of each transducer/driver is individually specified, thereby to direct sound emanating from the loudspeaker in desired vertical and/or horizontal directions.

The method includes assembling two or more vertical arrays of loudspeakers in side-by-side configuration, thereby to achieve the desired horizontal coverage.

The method also includes utilizing a rigging system to suspend the loudspeakers in substantially a straight line vertical array. The method of the present disclosure also utilizes loudspeakers which are substantially identical to each other in construction.

In the method of the present disclosure, the control system recognizes if a particular transducer/driver is not operational, and then adjusts the output of other operational transducers/drivers to compensate for the non-operational transducer(s)/driver(s).

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The attachments to this application, as well as the detailed description set forth below in connection with the appended drawings, where like numerals reference like elements, are intended as a description of various embodiments of the disclosed subject matter and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "vertical," "horizontal," "upright," "right-hand," "left-hand," "in," "out," "extended," "advanced," and "retracted." These references and other similar references in the present application are only to assist in helping describe and understand the present disclosure and invention and are not necessarily intended to limit the present disclosure or invention to these directions.

In the following description, various embodiments of the present disclosure are described. In the following description and in the accompanying drawings, the corresponding systems assemblies, apparatus and units may be identified by the same part number, but with an alpha or other suffix. The descriptions of the parts/components of such systems assemblies, apparatus and units are the same or similar, and therefore are not repeated so as to avoid redundancy in the present application.

Figure 1:
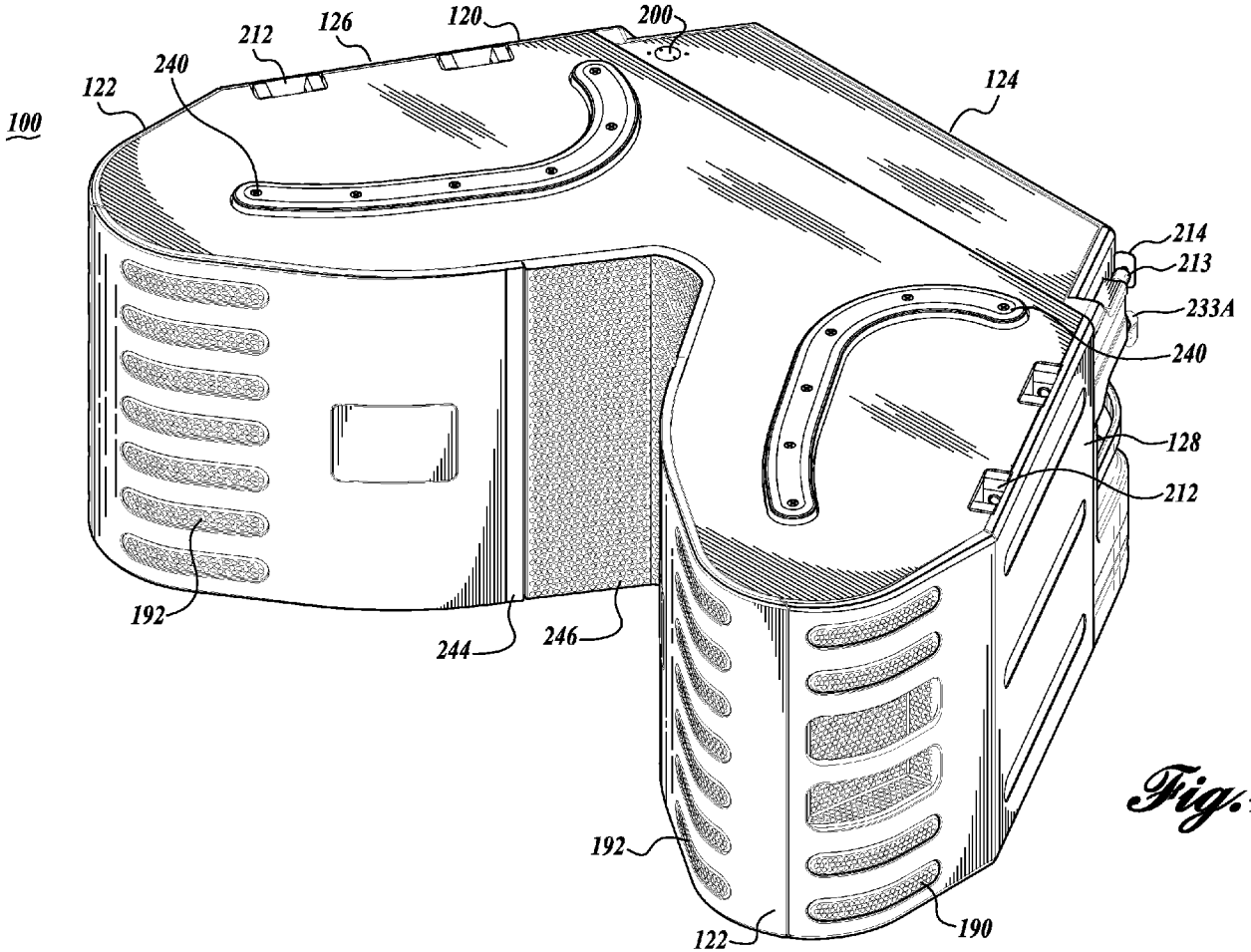
FIG. 1 illustrates a front perspective view of a loudspeaker of the present disclosure.
Figure 2:
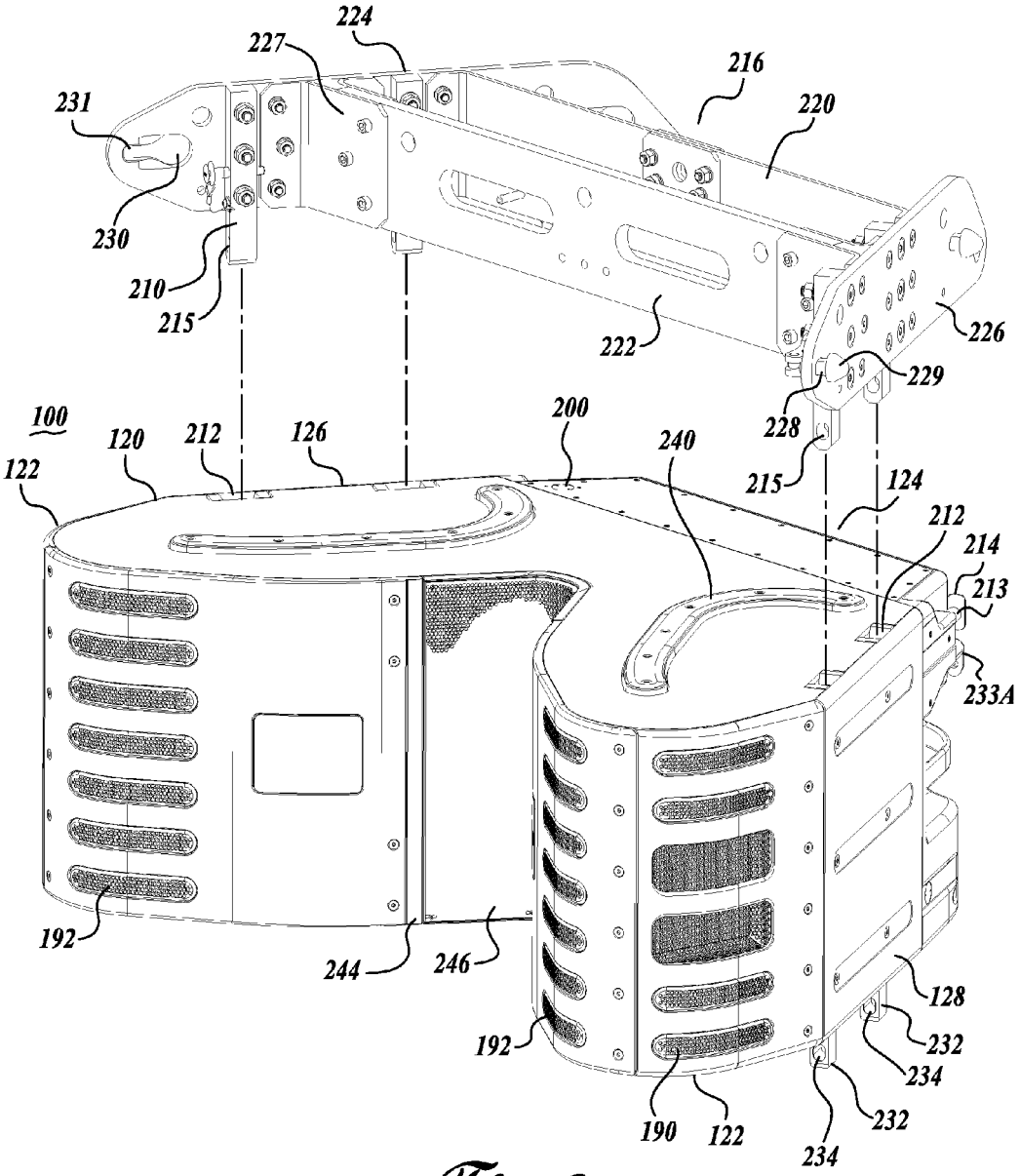
FIG. 2 illustrates the rigging for a loudspeaker array of the present disclosure.
Figure 3:
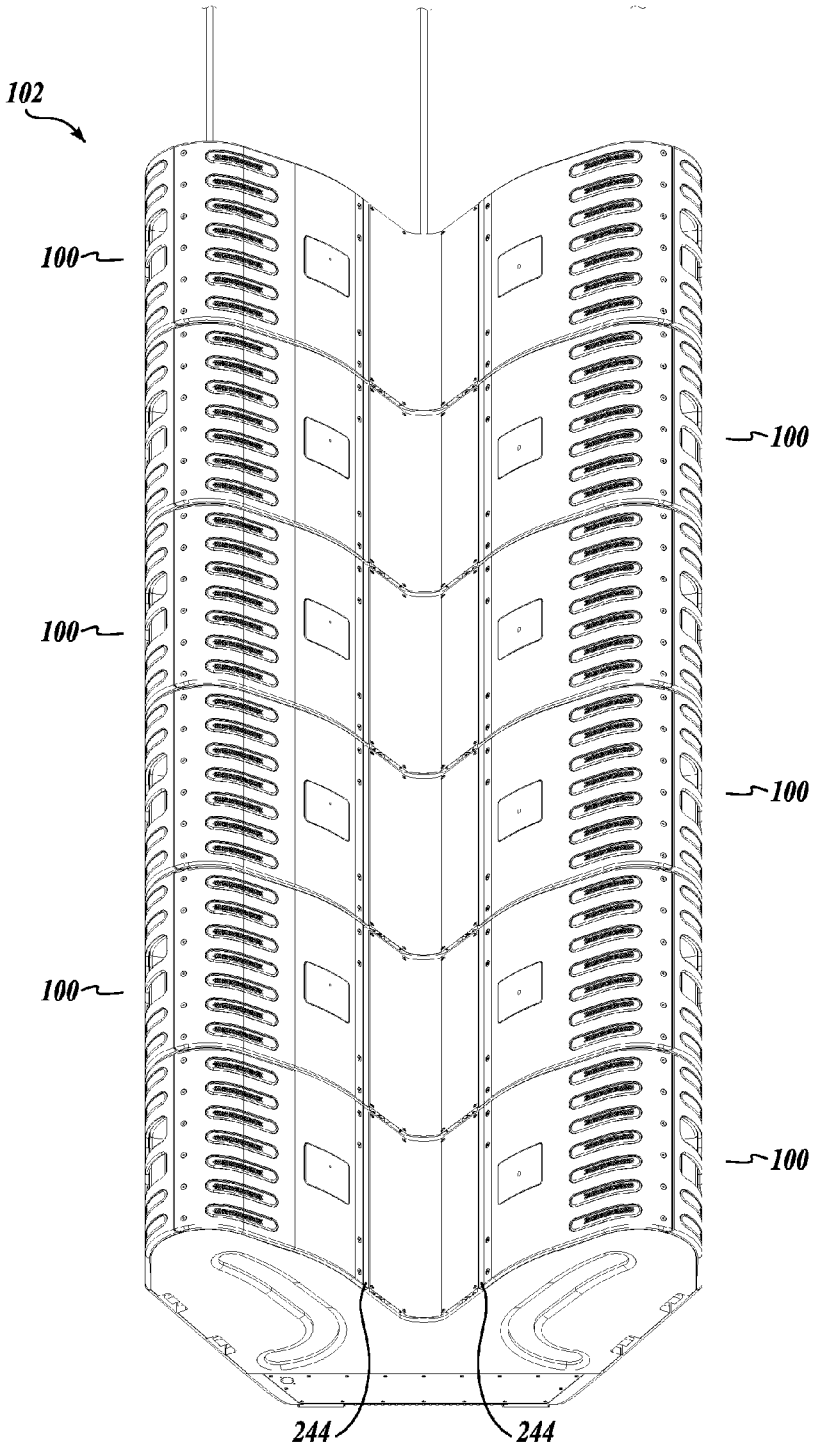
FIG. 3 illustrates loudspeakers of the present disclosure arranged in a vertical array.

An audio loudspeaker 100 (also "speaker") of the present disclosure is shown in FIGS. 1 and 2 as a singular unit and is shown in FIG. 3 as arranged in a vertical array 102 composed of six speakers 100 stacked on top of each other in vertical fashion.

Figure 4:
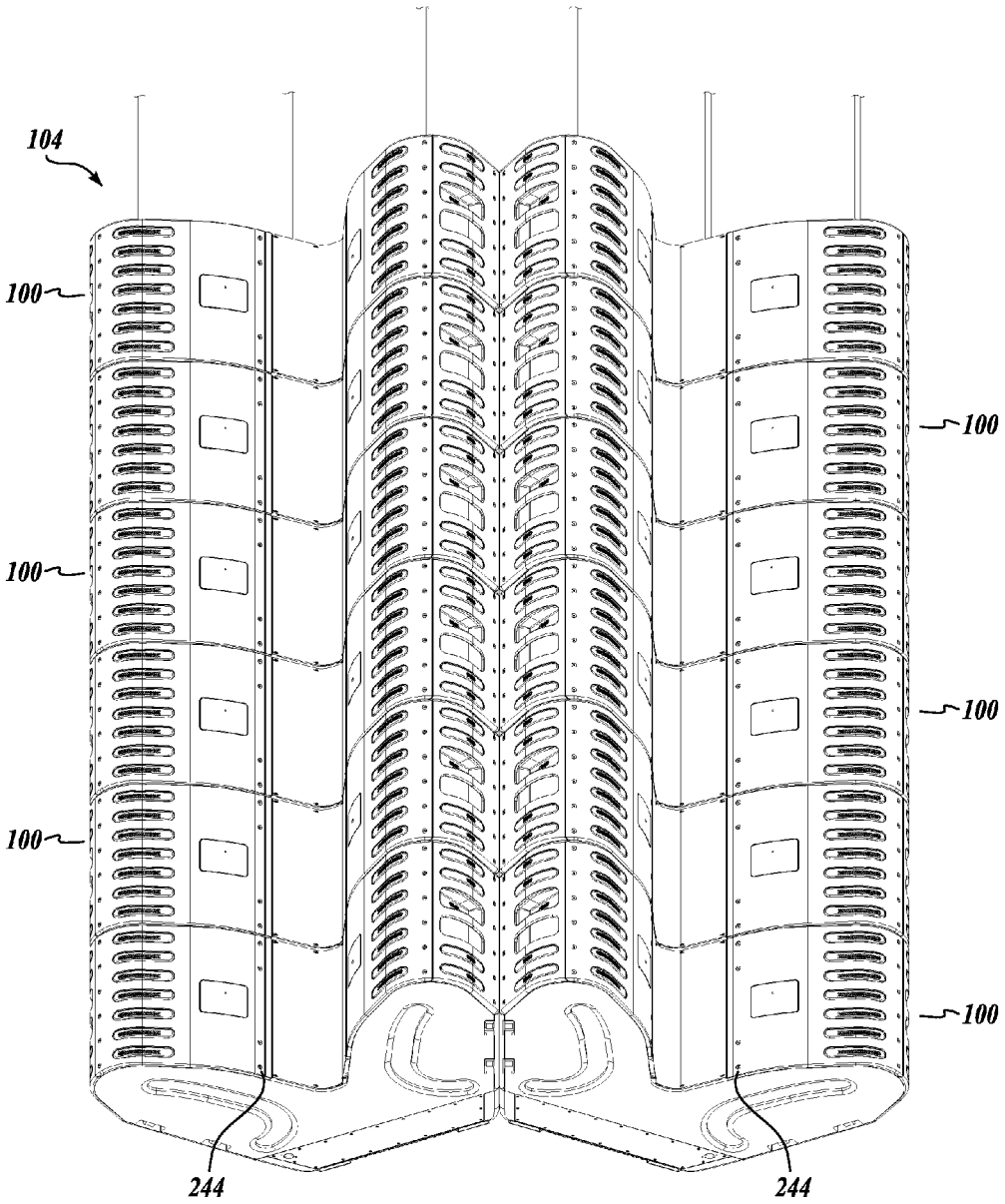
FIG. 4 illustrates loudspeakers of the present disclosure arranged in two side-by-side vertical arrays.
Figure 13:
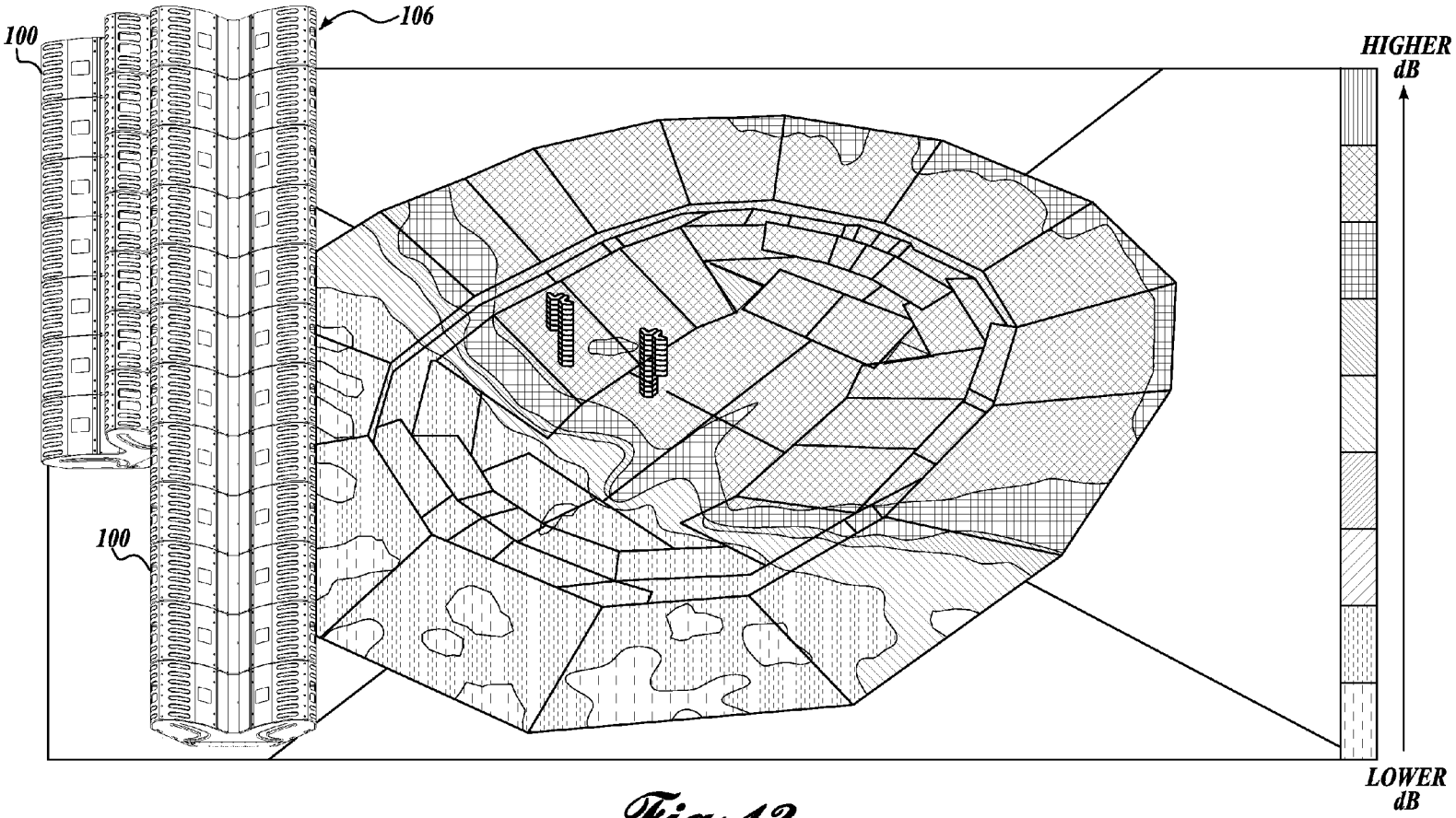
FIG. 13 illustrates loudspeaker arrays of the present disclosure arranged for a large indoor arena.
Figure 14:
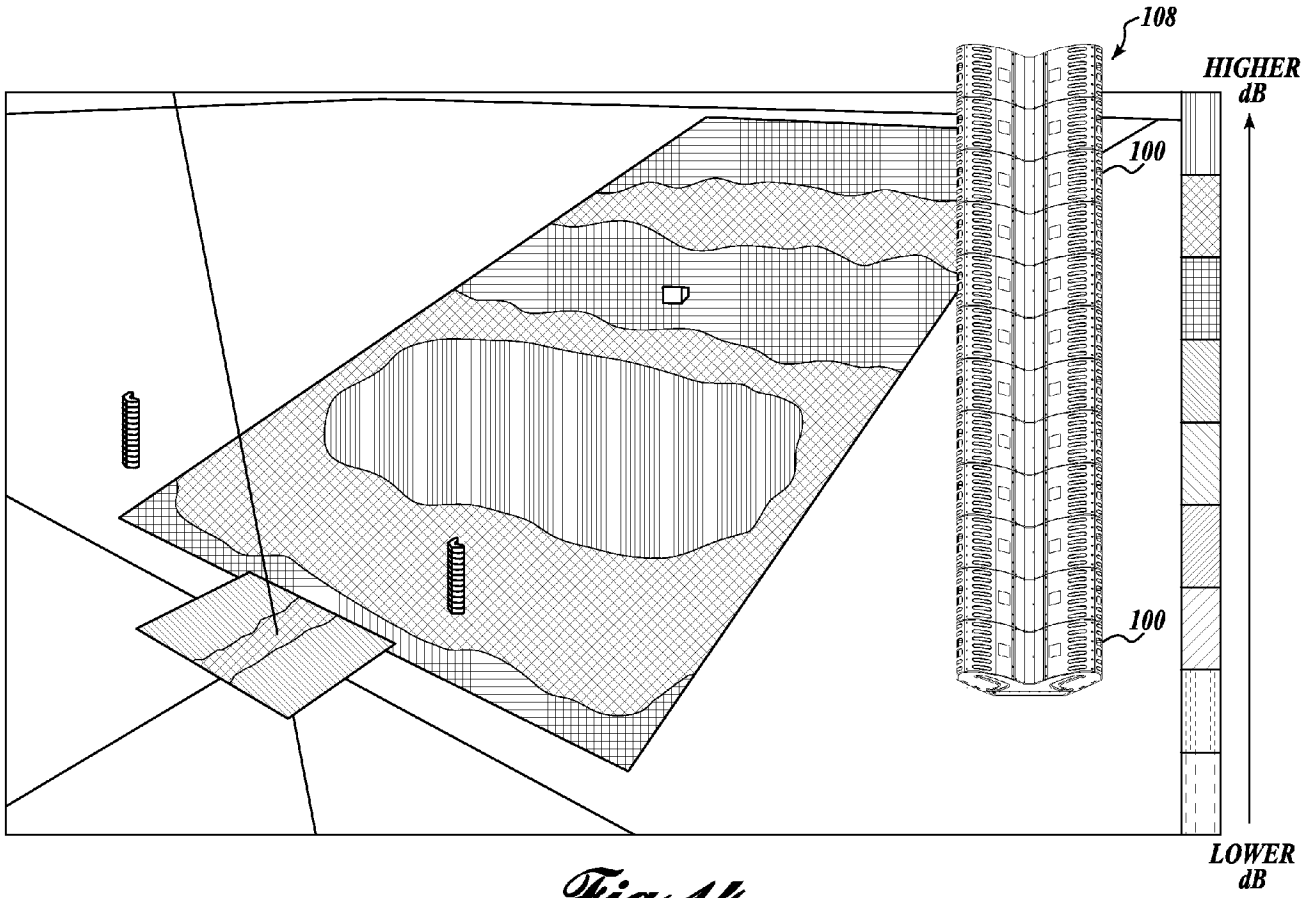
FIG. 14 illustrates the use of loudspeaker arrays of the present disclosure configured for an outdoor amphitheater.
Figure 15:
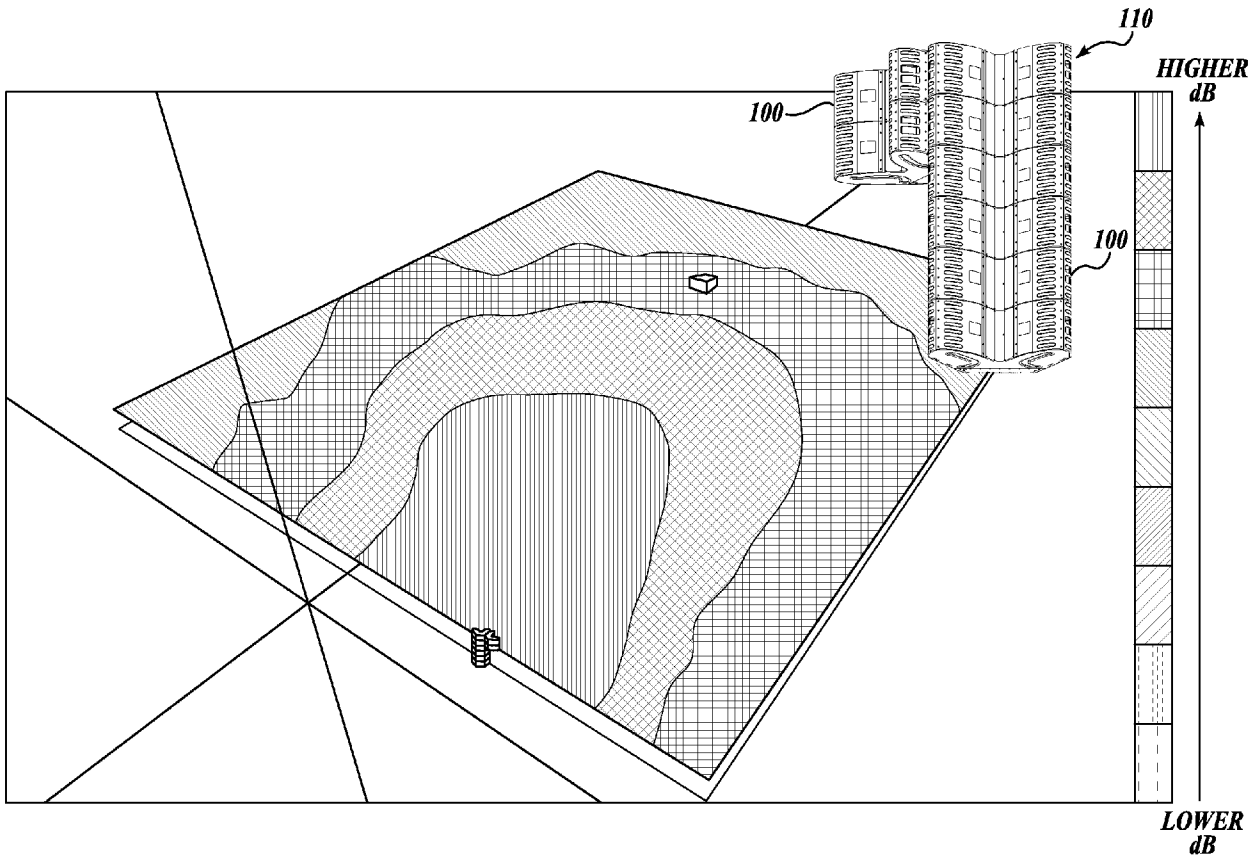
FIG. 15 illustrates loudspeaker arrays of the present disclosure configured for a large tent.
Figure 16:
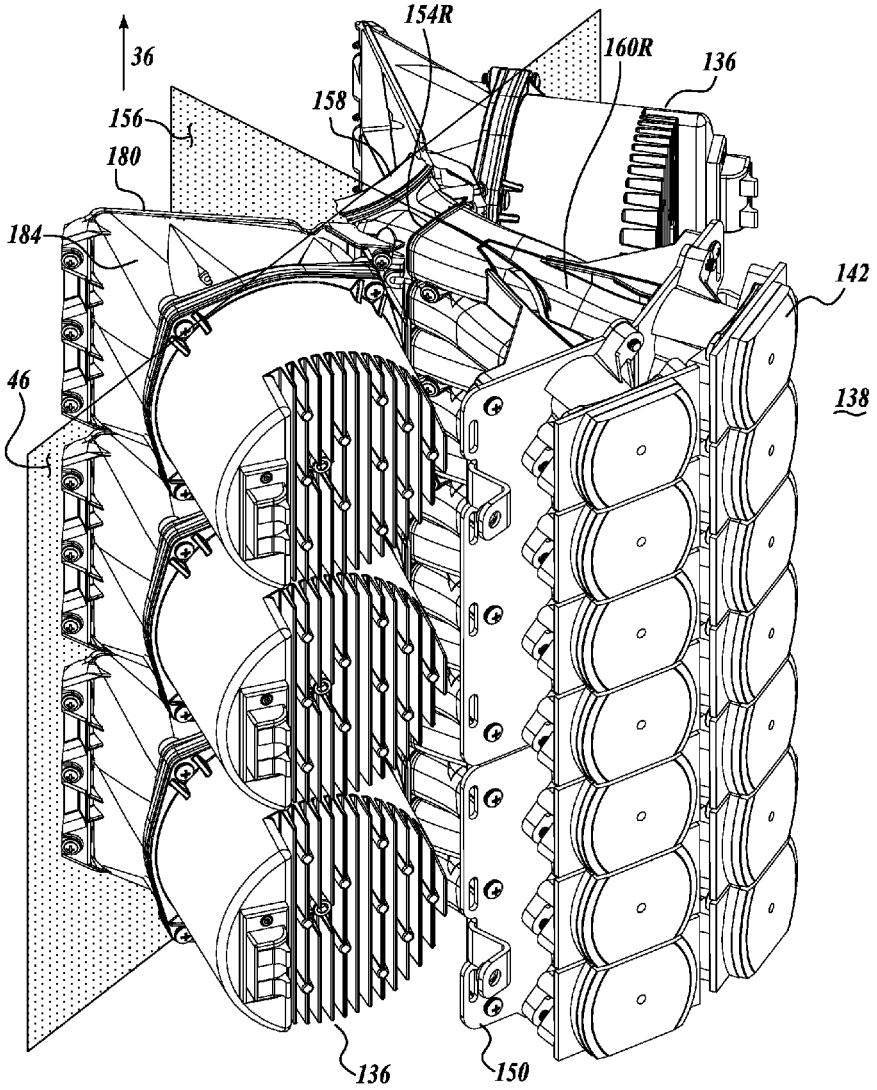
FIG. 16 is an isometric view of the high-frequency compression drivers and mid-range cone transducers configured for use in a speaker of the present disclosure, shown without a housing.
Figure 17:
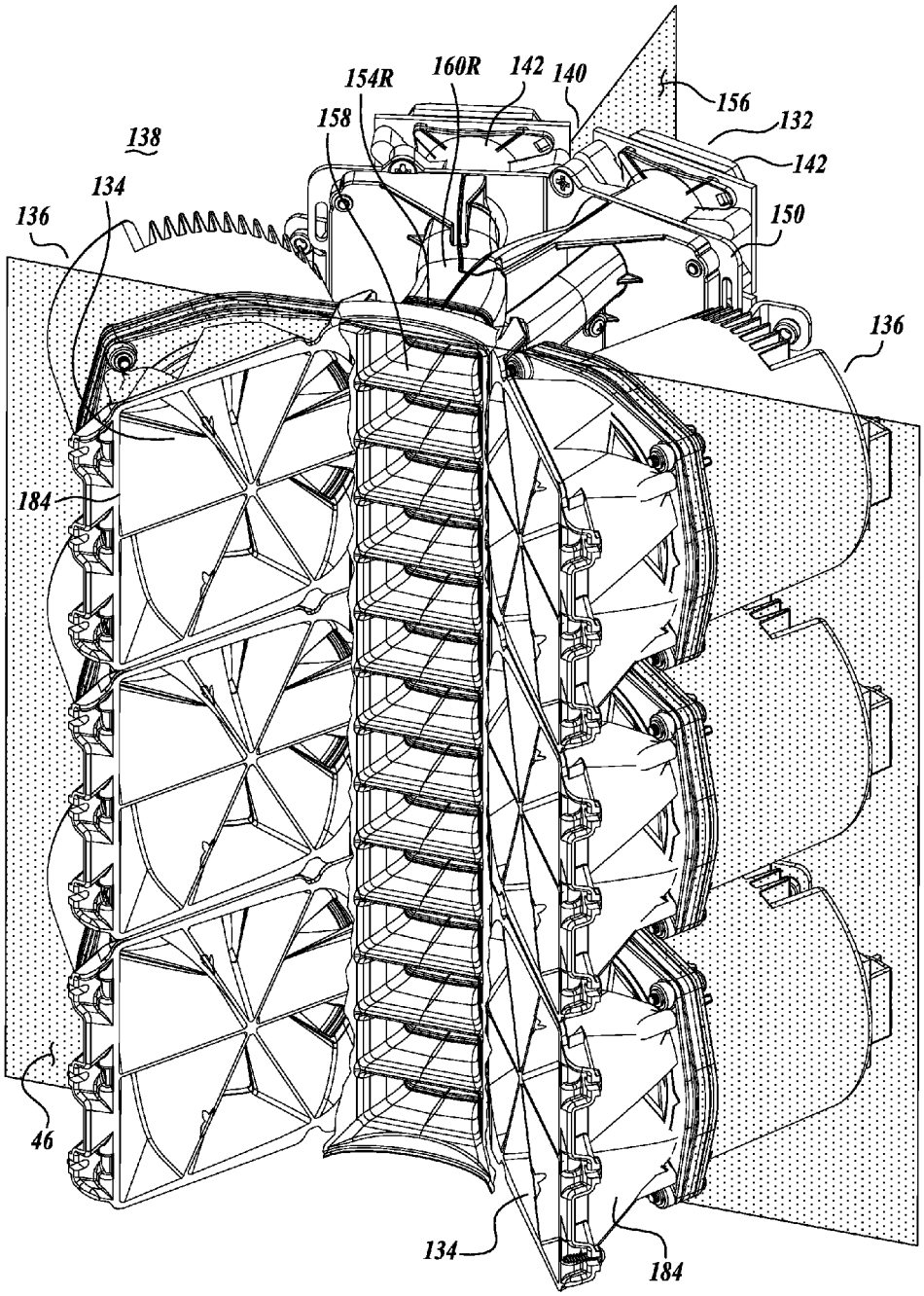
FIG. 17 is a front perspective view of FIG. 16.
Figure 18:
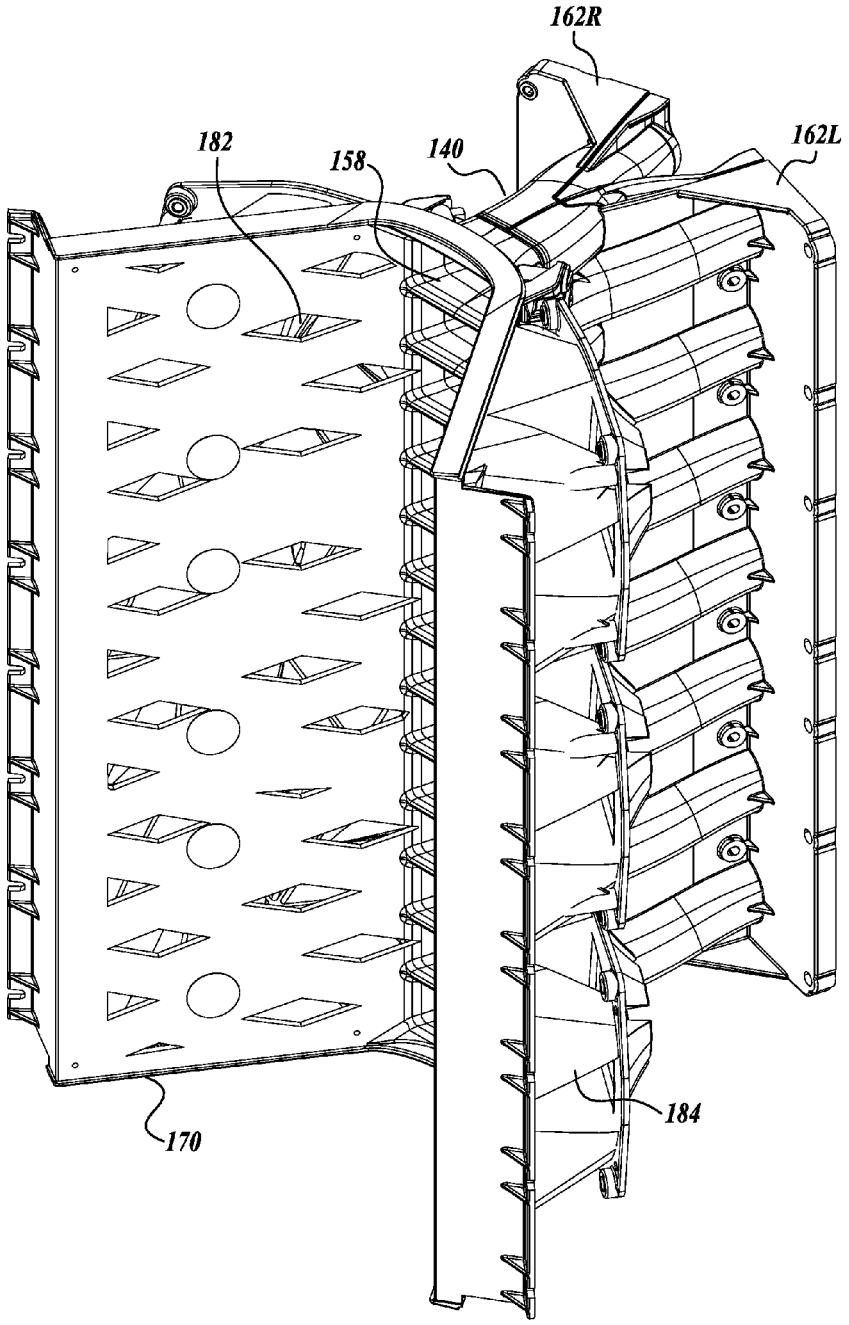
FIG. 18 is a view similar to FIG. 17, but with the addition of a horn wall.
Figure 19:
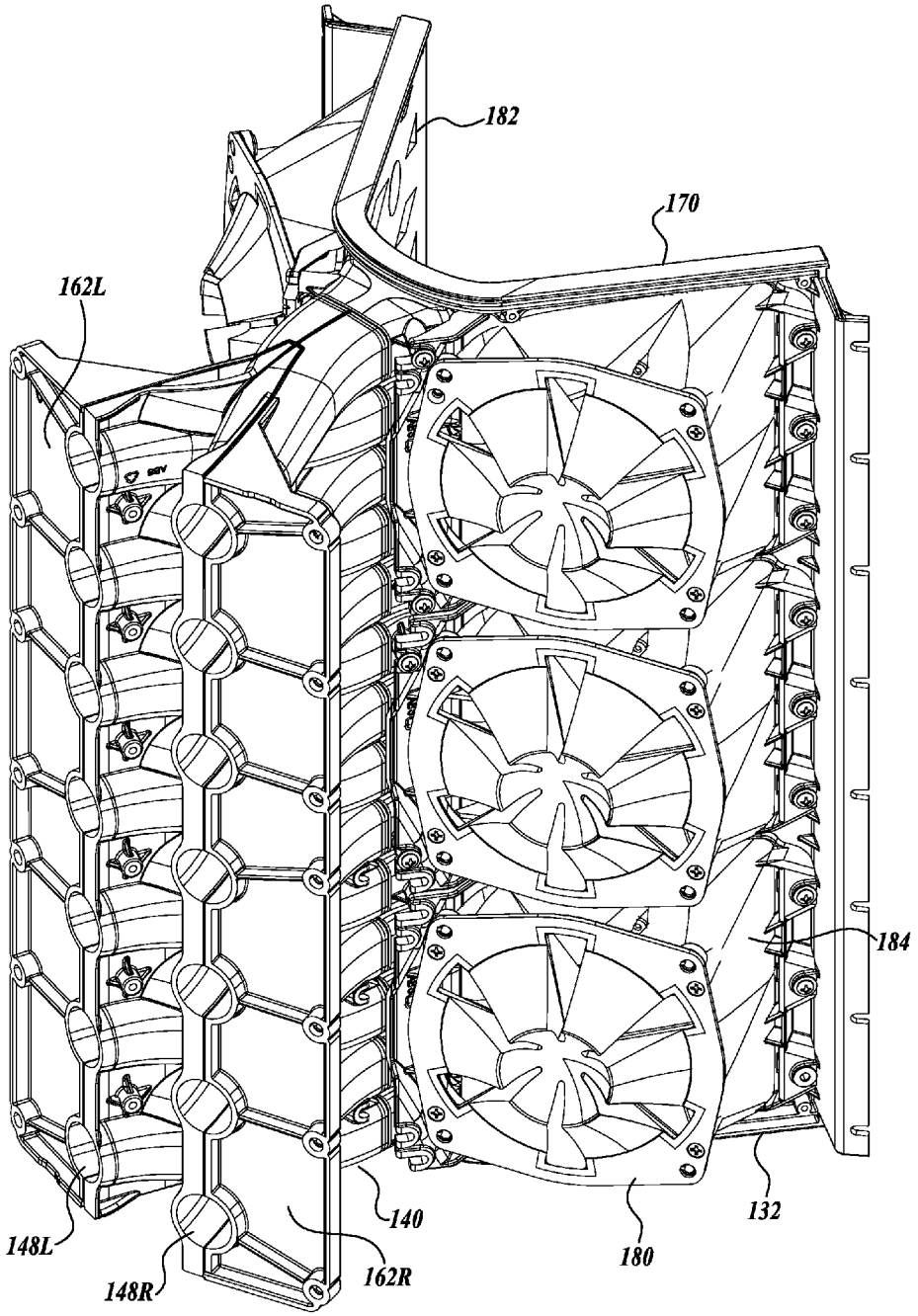
FIG. 19 is a view similar to FIG. 17, but from the opposite side from that shown in FIG. 17.
Figure 20:
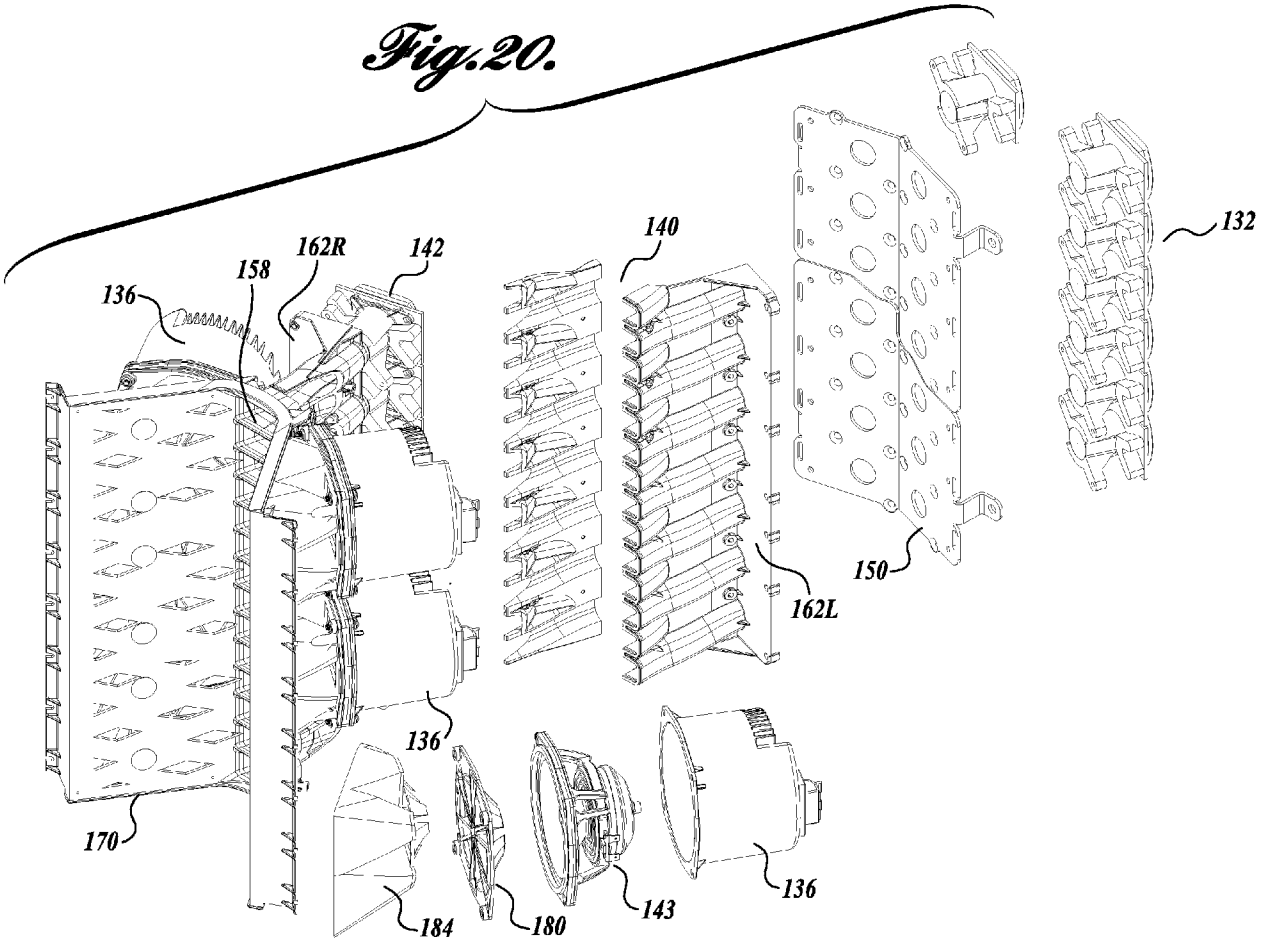
FIG. 20 shows the components of FIGS. 16-19 in partially disassembled condition.
Figure 21:
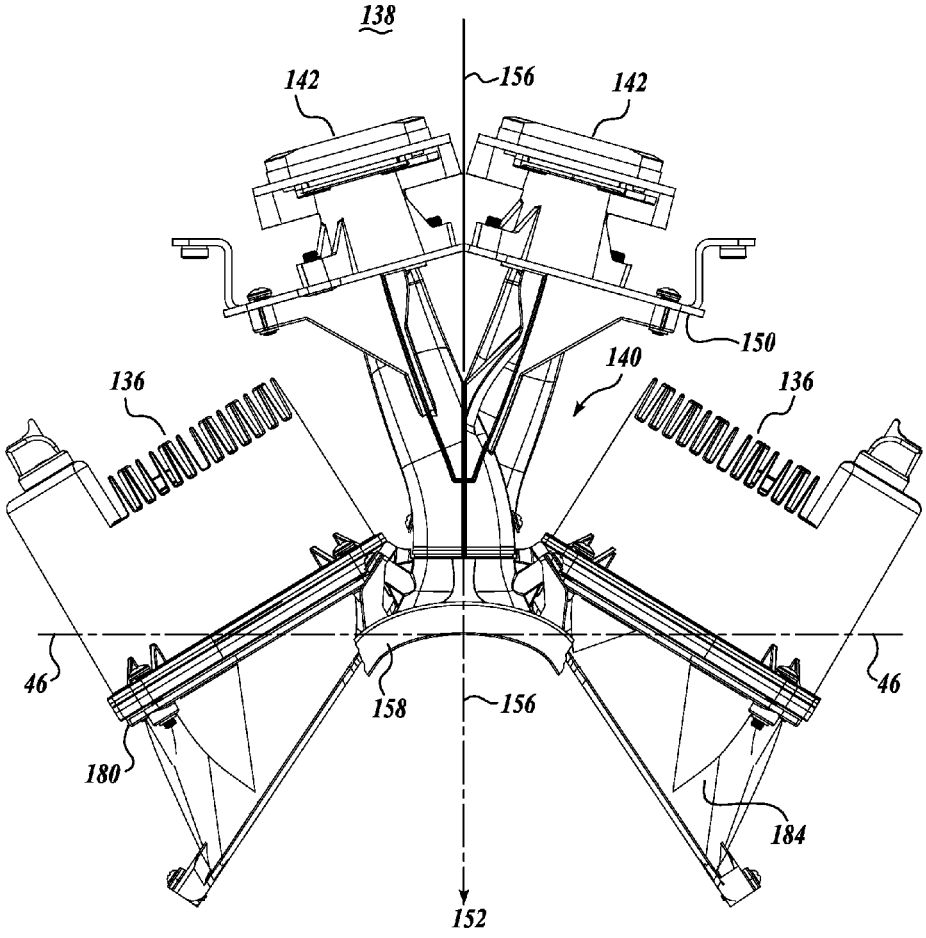
FIG. 21 is a top view of FIG. 16.
Figure 22:
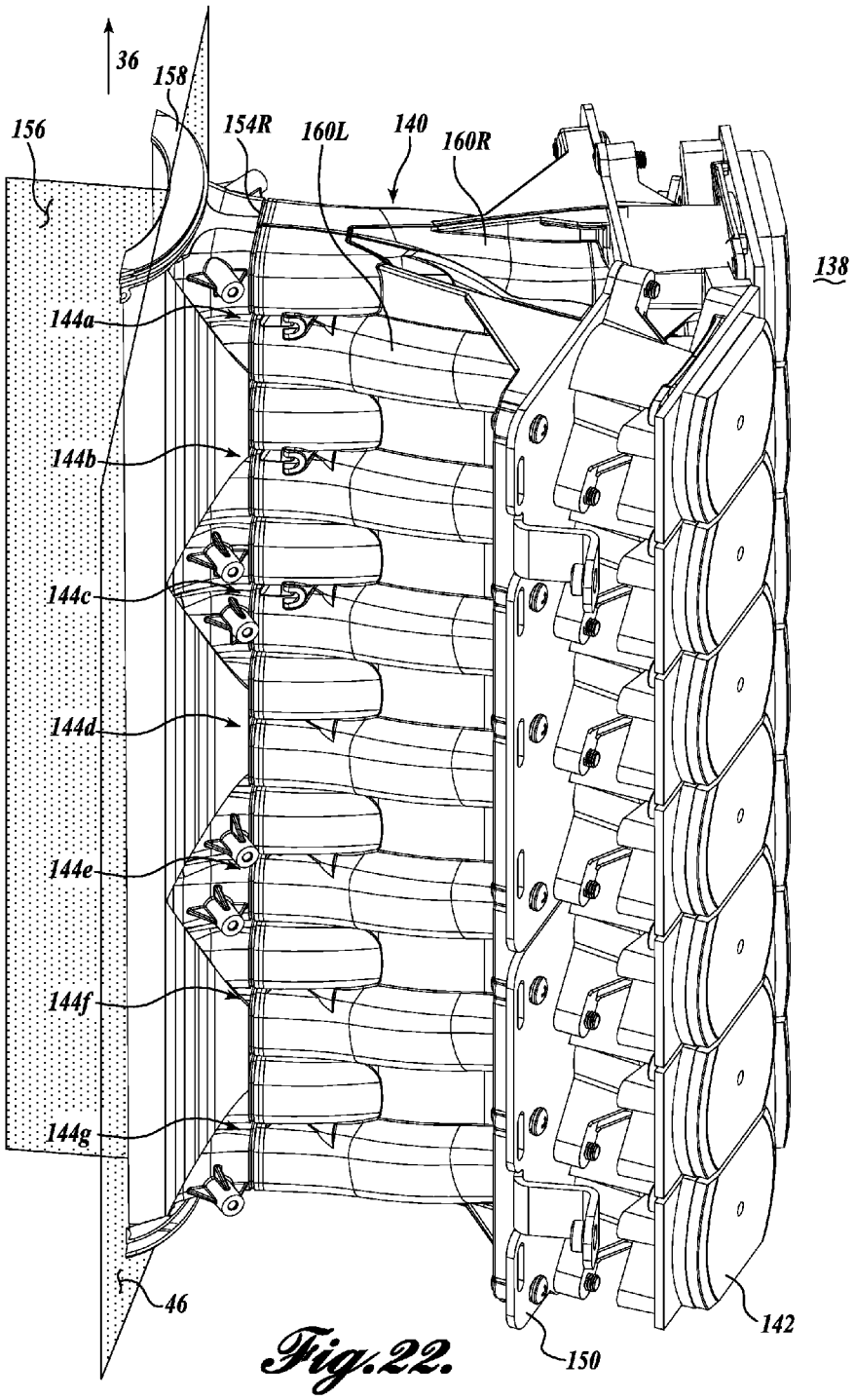
FIG. 22 is a side perspective view of FIG. 16, but with the mid-range cone transducers removed.
Figure 23:
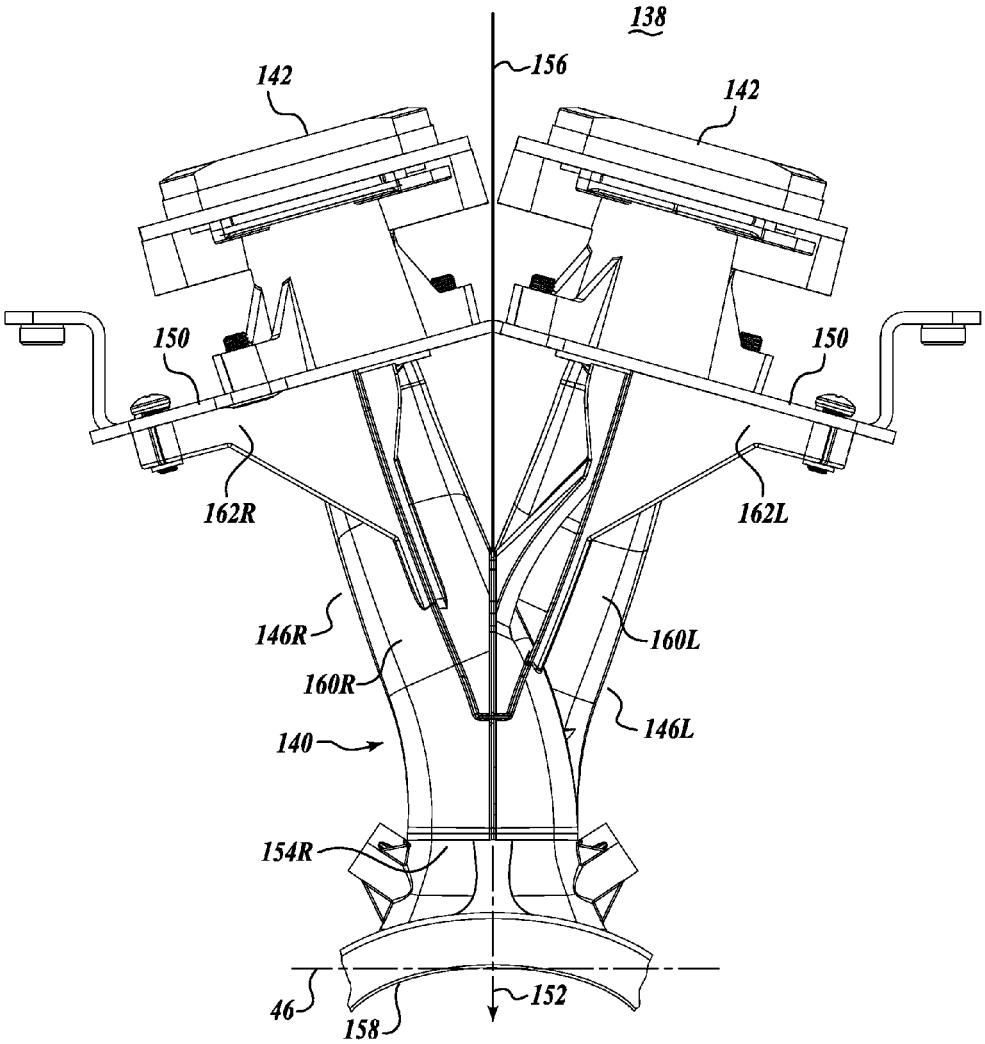
FIG. 23 is a top view of FIG. 22.

Other speaker arrays can also be composed of speakers 100 including as shown in FIG. 4, a speaker array 104 having two speaker stacks each composed of six speakers, with the two stacks positioned side-by-side to each other. FIG. 13 illustrates a speaker array 106 composed of two side-by-side stacks configured for use in a large indoor arena having a stage. One stack consists of 12 speakers 100, and the second stack consists of six speakers 100, with the top of the stacks level with each other. The two stacks cover 120 degrees horizontally, but vary in their vertical directivity. FIG. 14 illustrates speaker arrays 108 utilized in a large outdoor amphitheater. The arrays 108 are located spaced apart from each other at one end of the amphitheater. Further, FIG. 15 illustrates a speaker array 110 configured for a concert within a very large tent. The arrays 110 are in two side-by-side stacks, a first stack consisting of six speakers 100 and the second side-by-side stack composed of two speakers 100. The six-module column covers most of the audience area, and a two-module outer column fills the intermediate near field as well as the side of the venue on which the short stack is positioned.

Figure 5:
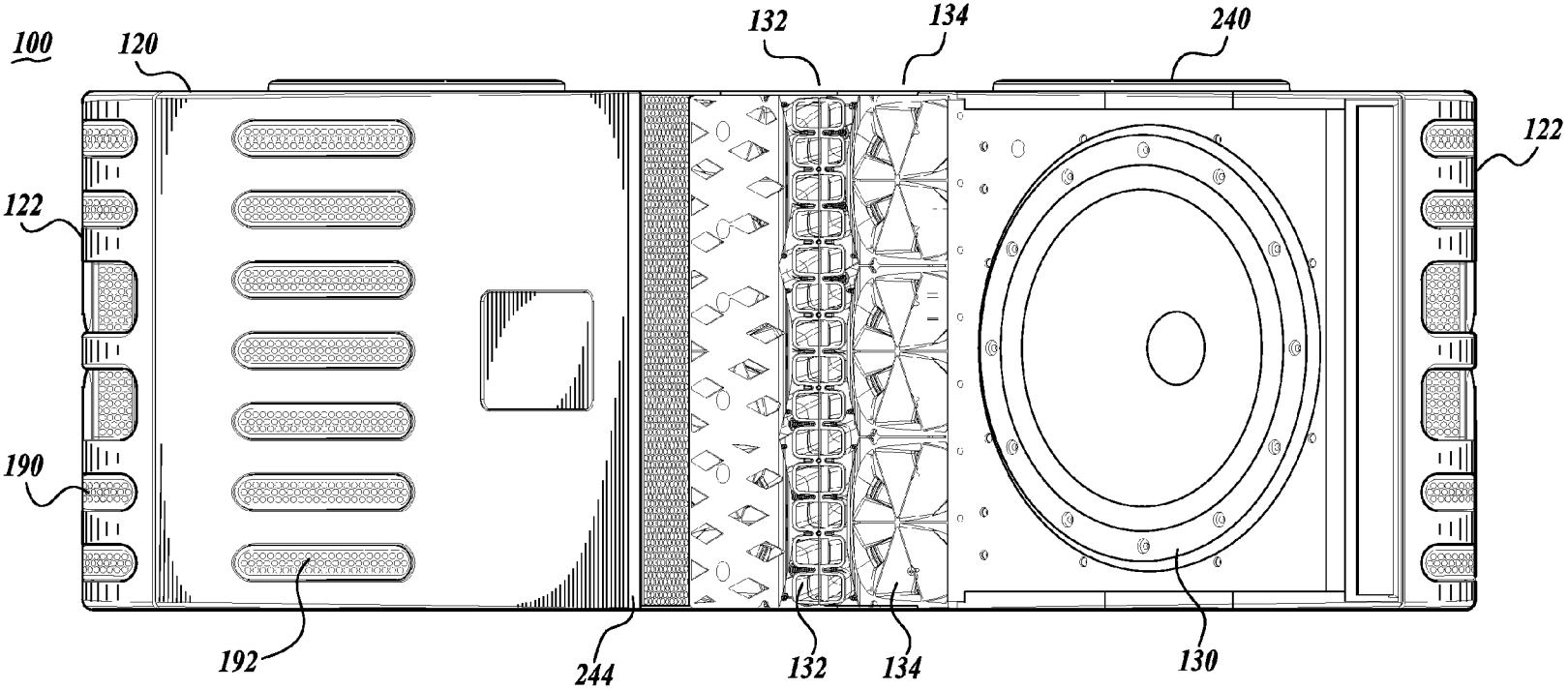
FIG. 5 illustrates a front elevational view of a loudspeaker of FIG. 1 shown with portions broken away to view the interior of the loudspeaker.
Figure 6:
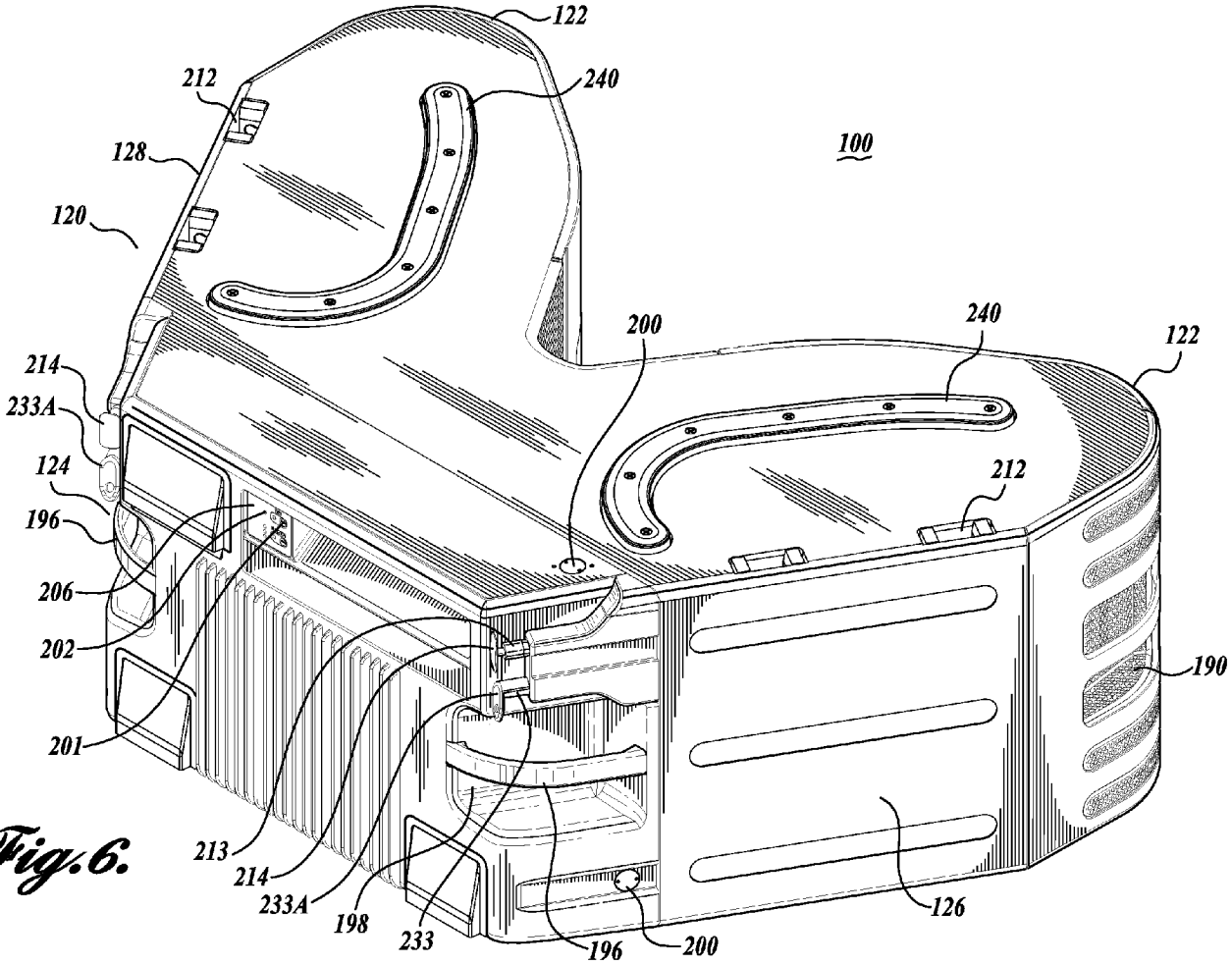
FIG. 6 is a rear isometric view of the loudspeaker of FIG. 1.
Figure 7:
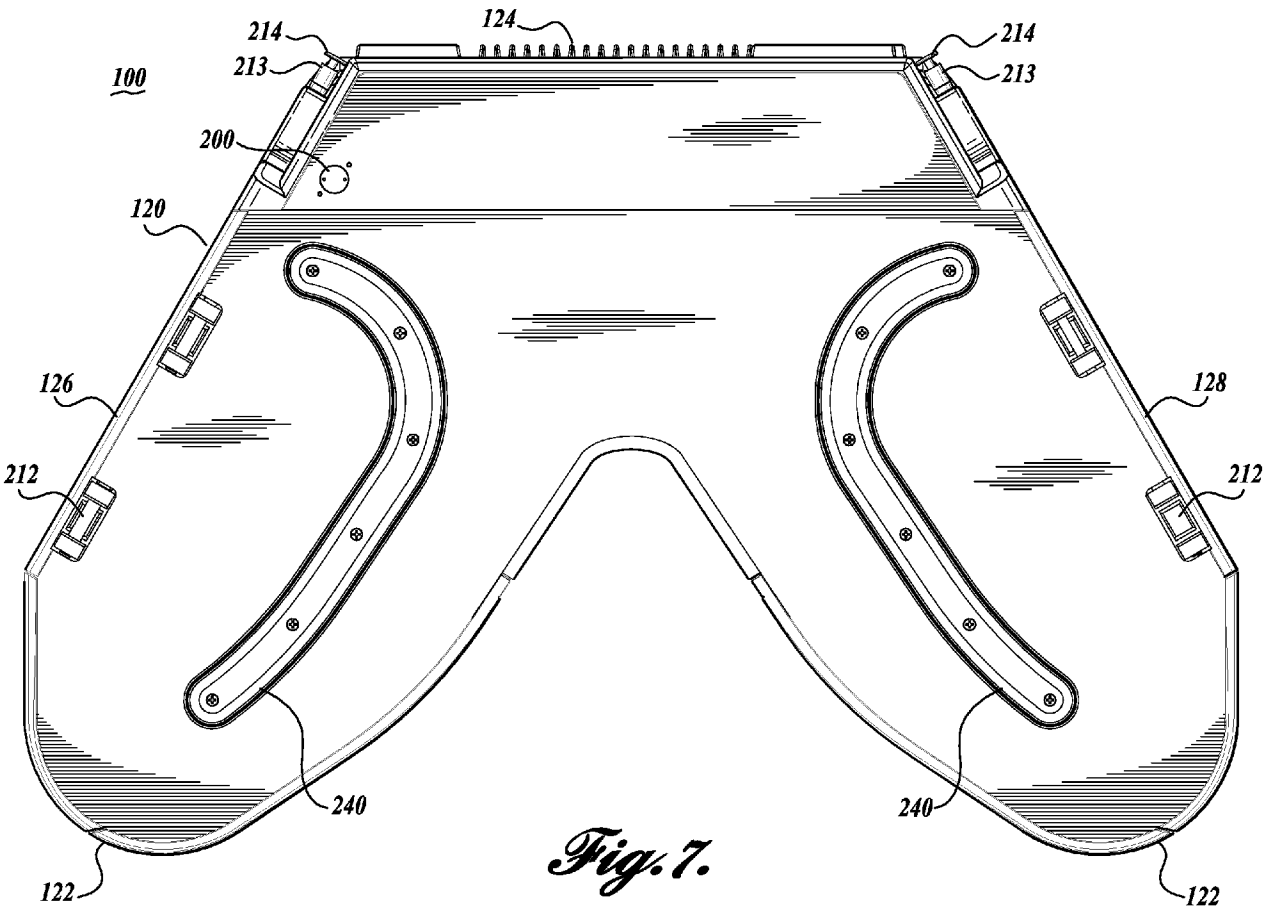
FIG. 7 is a top plan view of FIG. 1.
Figure 8:
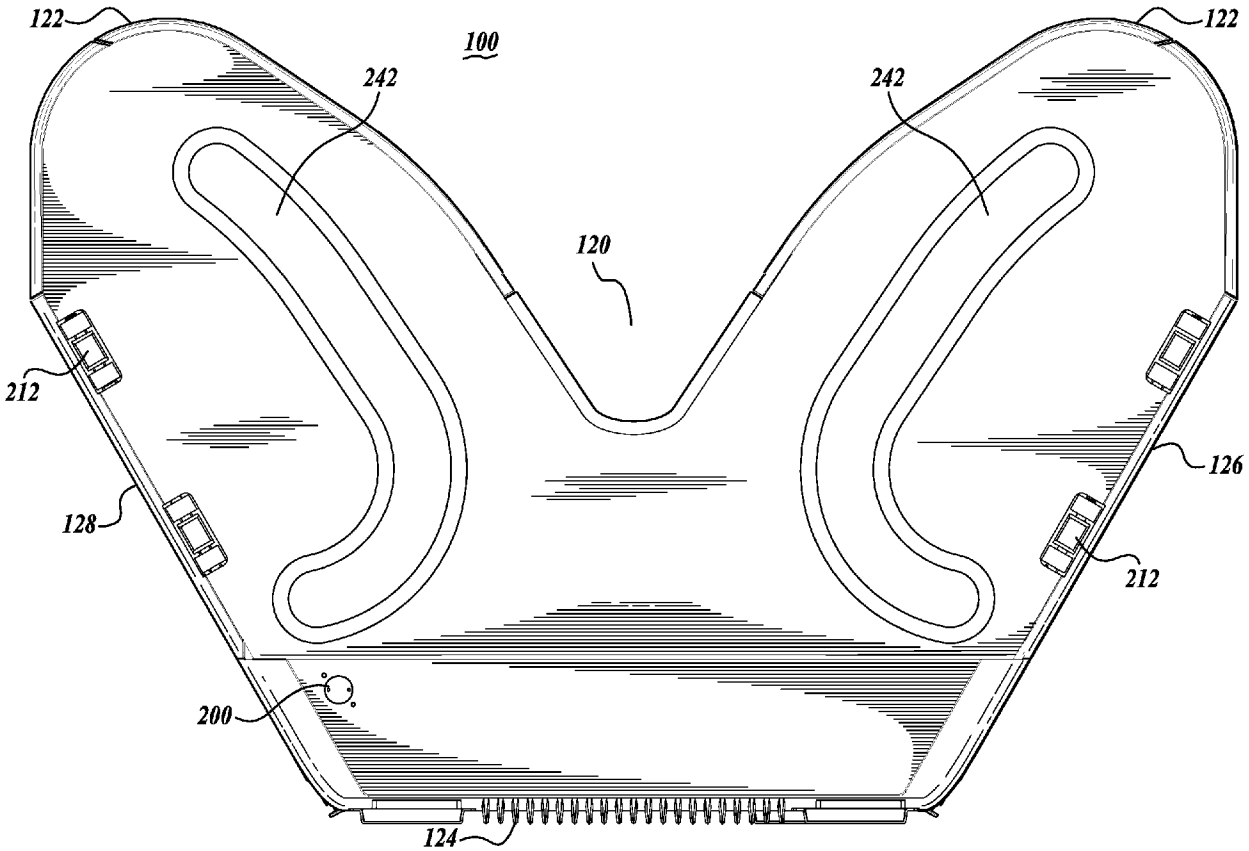
FIG. 8 is a bottom view of FIG. 1.

Next, describing the individual speakers 100, reference initially will be made primarily to FIGS. 1, 2, and 5-12. As shown in these figures, the speaker 100 includes a generally trapezoidal-shaped housing 120 composed of two lobe sections 122 that project forwardly and outwardly from the transverse rear section 124. The housing 120 includes side portions 126 and 128 extending rearwardly and diagonally inwardly from the front lobe sections to intersect the transverse rear section 124. Referring specifically to FIG. 5, a pair of low-frequency cone transducers 130, operating in the range of about 30 Hz to 300 Hz, are housed in the lobe portions 122 of housing 120. The low-frequency transducers 130 occupy substantially the entire height and width of the lobe portions to face forwardly and inwardly toward each other. A vertically arranged set 138 of high-frequency compression drivers 142, operating in the range of about 1500 Hz to 20 kHz, are positioned centrally in the housing between the lobe sections to project in the forward direction, see FIG. 5 as well as FIGS. 16, 17, 20-23. The set 138 also includes three mid-frequency cone transducers 143, operating in the range of about 200 Hz to 2 kHz, that are vertically arranged along each side of the high-frequency drivers 132, see FIG. 5 as well as FIGS. 16, 17, 19, 20 and 21. Although three mid-frequency cone transducers 143 are shown on each side of the high-frequency horn, a greater or lesser number of mid-frequency cone transducers 143 may be utilized.

As described above, the forward portion of housing 120 is occupied by the high, mid-range, and low-frequency compression drivers/transducers 142, 143, and 130. The power components and control components of the speaker 100 are located in the transverse rear section 124 of the speaker.

Describing aspects of the speaker 100 in greater detail, FIGS. 16-29 focus on the high-frequency and mid-frequency drive assembly 138 composed of high-frequency compression drivers 142 and mid-frequency cone transducers 143. These aspects of the speaker 100 are illustrated and described in U.S. patent application Ser. No. 13/832,817, incorporated herein by reference. The high-frequency compression drivers 142 include a horn structure 140 powered by high-frequency drivers 142. The horn structure 140, which loads the compression drivers, includes an array of horn pairs 144*a*-144*g*, with the horn pairs stacked in vertical relationship to each other. Each horn pair is composed of a left- and right-hand horn designated as 146L and 146R as shown, for example, in FIG. 22. The high-frequency driver 142 is mounted to the inlets 148L and 148R of horns 146L and 146R, respectively. A formed mounting plate 150 is disposed between inlets 148L and 148R and corresponding drivers 142.

Figure 24:
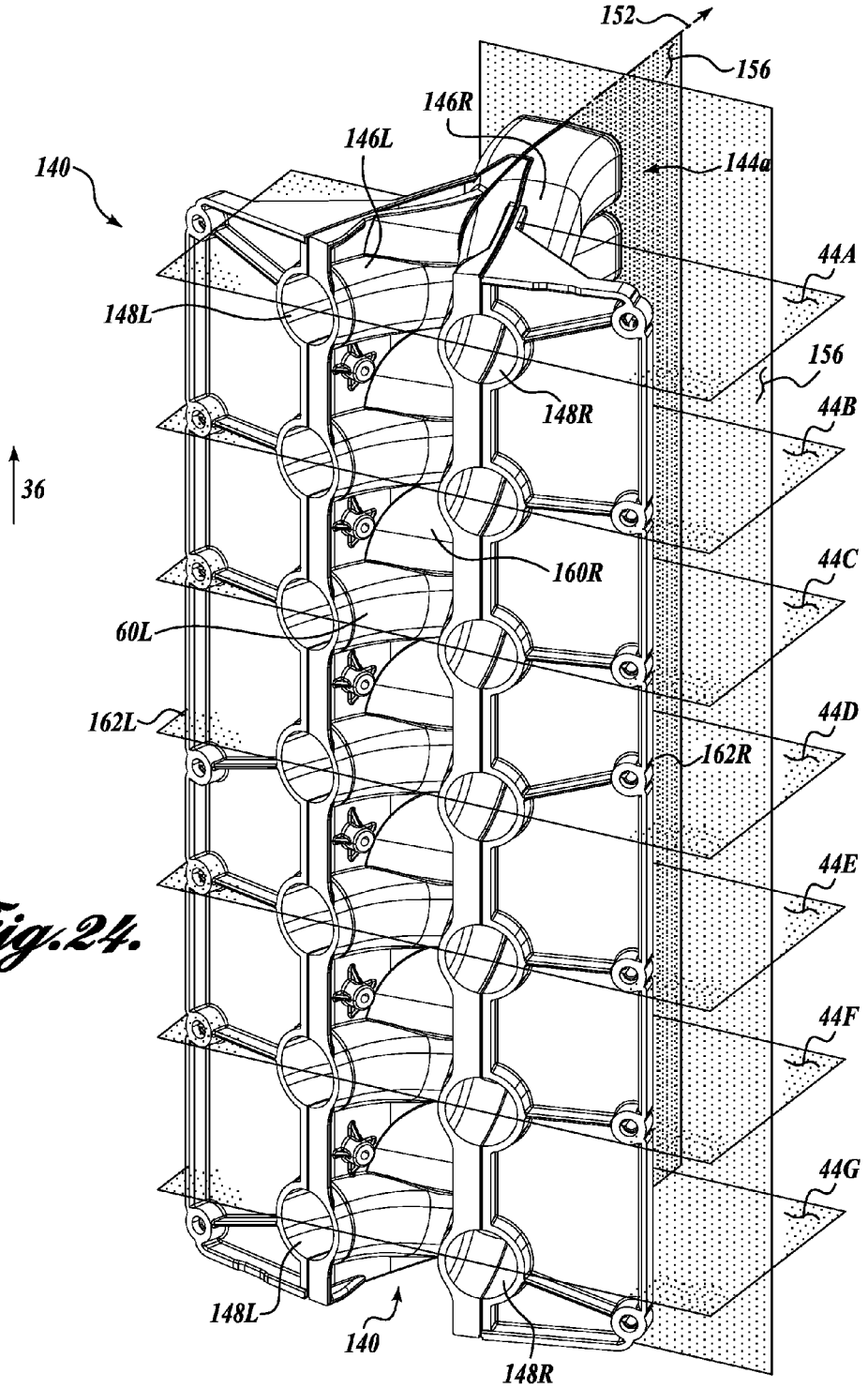
FIG. 24 is a rear perspective view of FIG. 22, but with the horn drivers removed.
Figure 25:
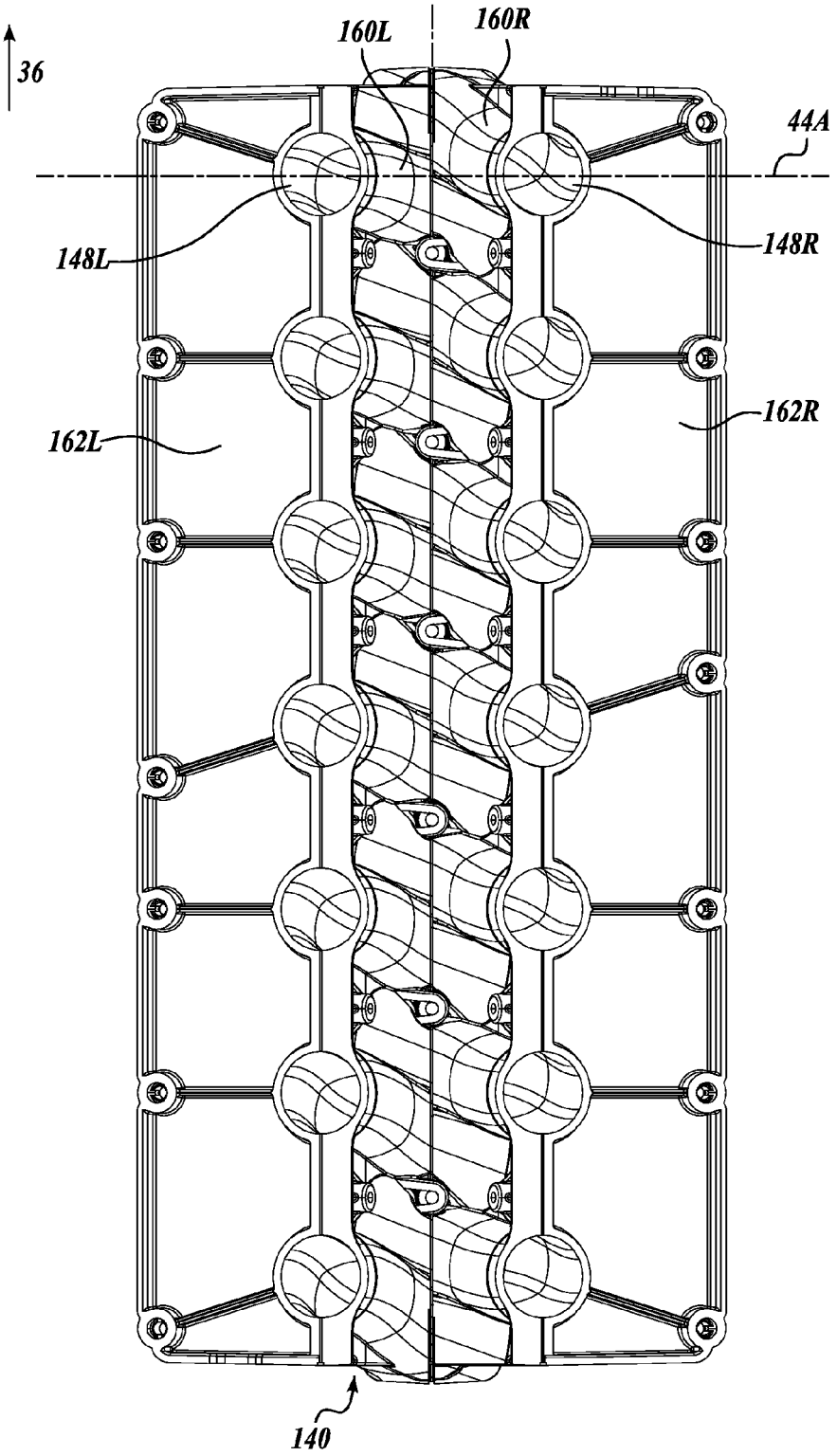
FIG. 25 is a rear elevational view of FIG. 22.
Figure 26:
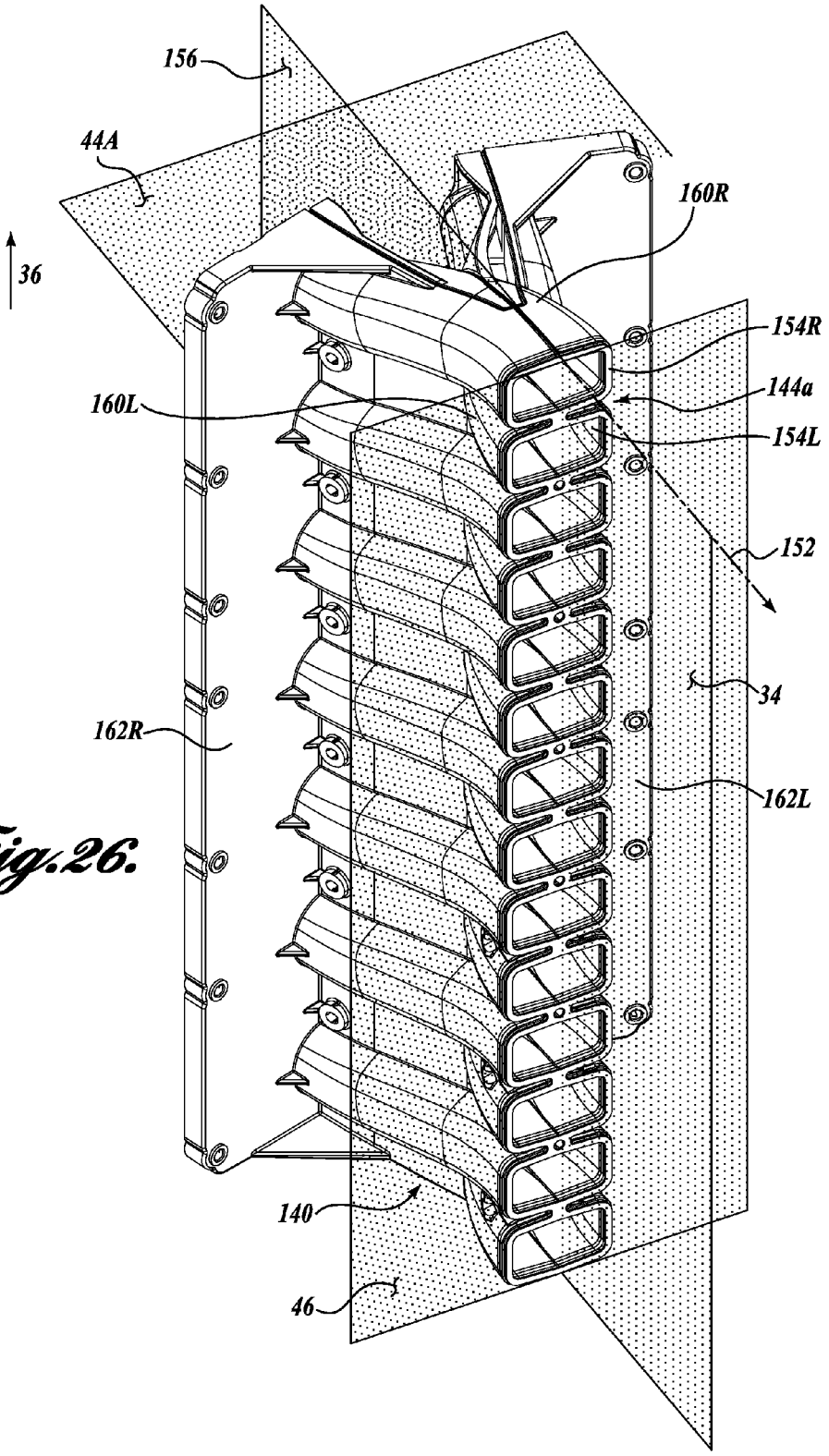
FIG. 26 is a front perspective view of FIG. 22.
Figure 27:
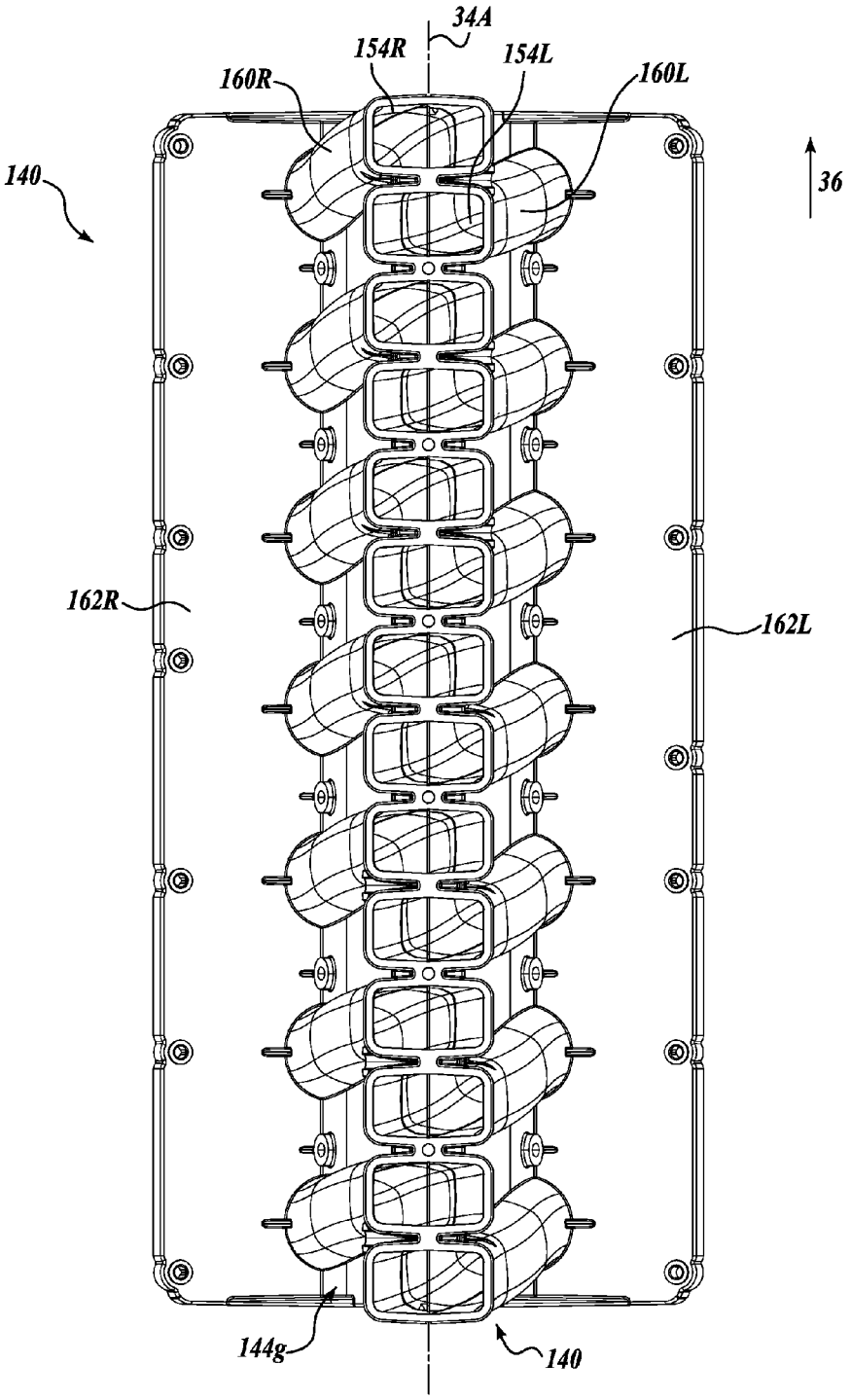
FIG. 27 is a front elevational view of FIG. 22 showing the output openings of the high-frequency housing structure.
Figure 28:
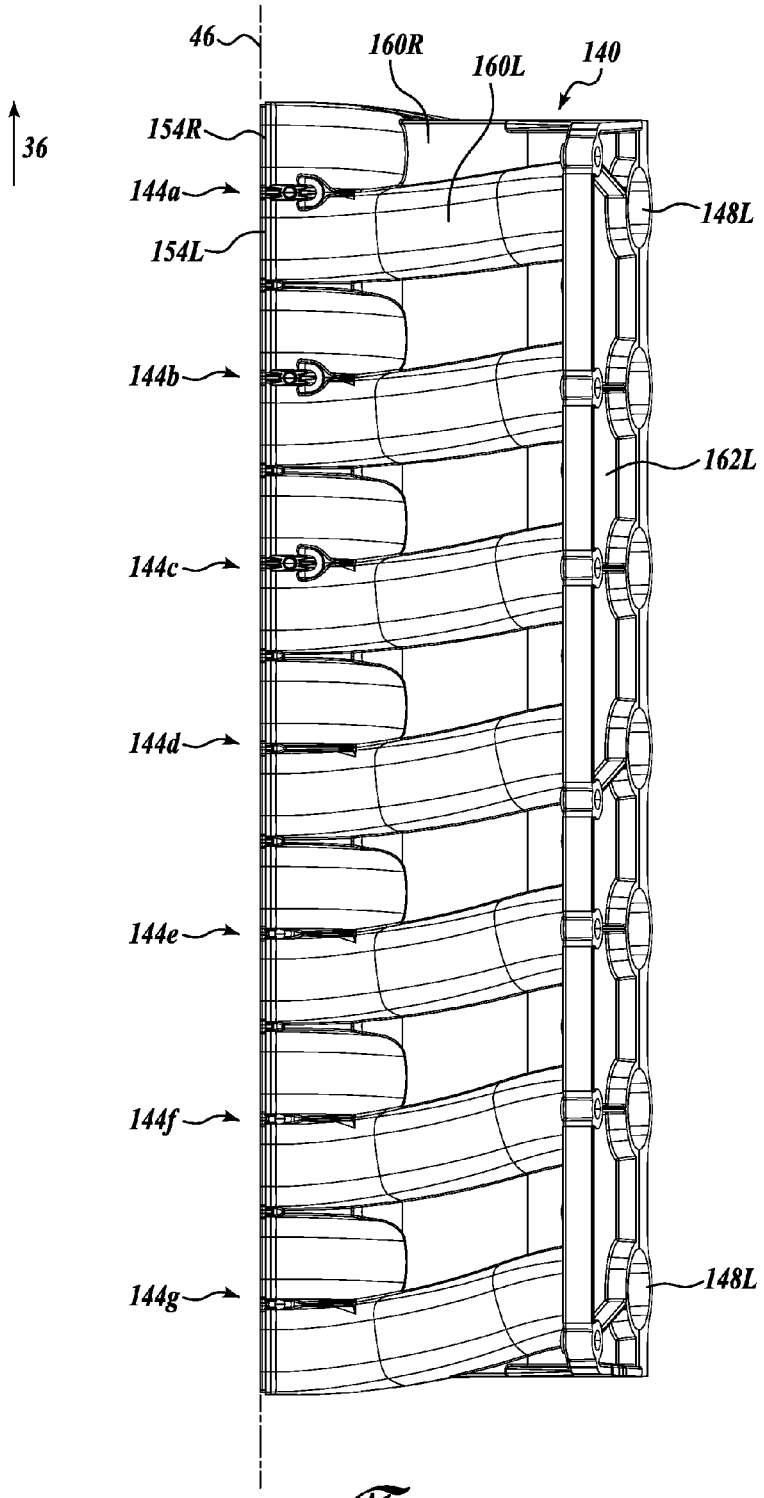
FIG. 28 is a side elevation view of FIG. 22.
Figure 29:
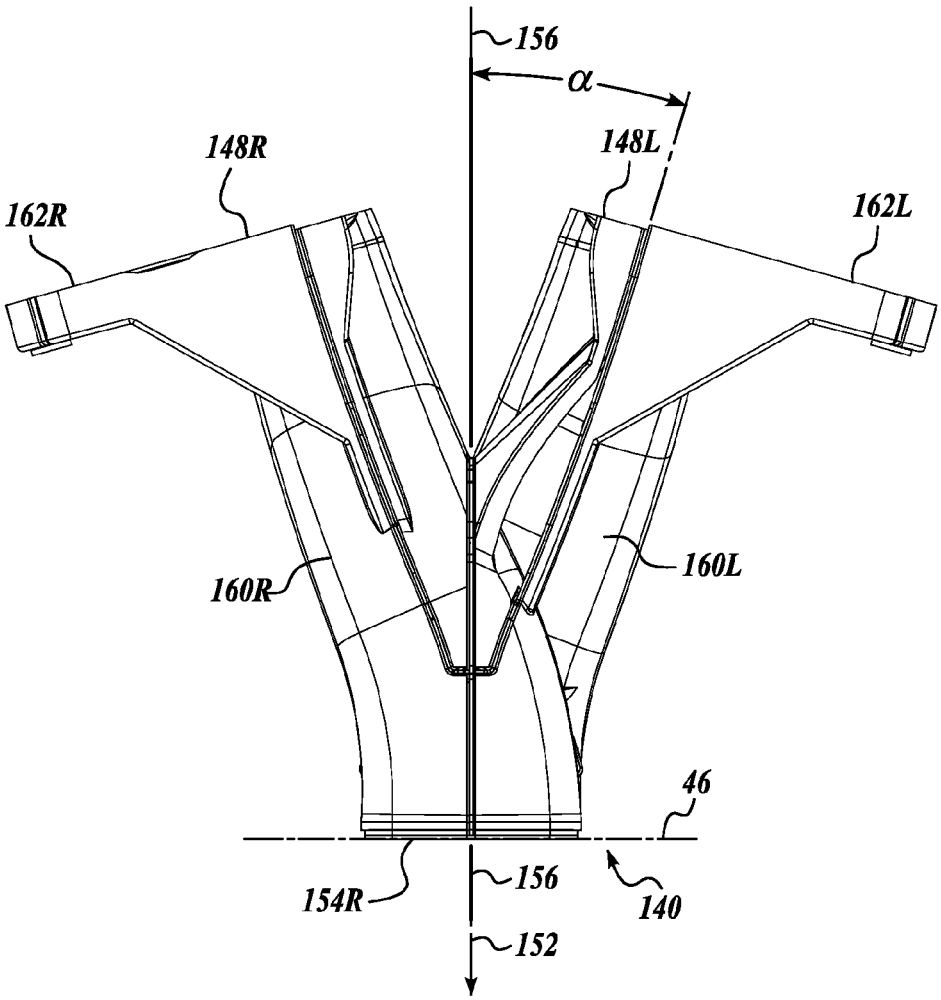
FIG. 29 is a top view of FIG. 22.

As perhaps best shown in FIGS. 24 and 25, the entrance openings or inlets 148L and 148R of the horns of each pair 144 are positioned side-by-side to each other. The entrance openings 148L and 148R are shown as being at the same elevation to each other, but they can be at different elevations to each other. Also, the inlets 148L and 148R are shown as round in shape, though the inlets do not necessarily have to be round. As perhaps best illustrated in FIG. 29, the inlets 148L and 148R are angled or canted with respect to a central axis 152 rather than being perpendicular to the axis. The angle $\alpha$ between the central axis 152 and the central axis of inlets 148L and 148R can be selected so as to provide enough separation between the drivers 142 to avoid interference therebetween. The angle $\alpha$ is shown in FIG. 29 to be of approximately 17 degrees, but the angle $\alpha$ can be in the range of 0 to 180 degrees.

The horn mouths 154L and 154R are in directional alignment with a central plane 156 which is in turn aligned with central axis 152, whereby the horn mouths are disposed in adjacent relationship to each other. In one embodiment of the present disclosure, the horn mouths 154L and 154R are stacked on top of each other, with the front of the mouths in vertical alignment. However, the front of the mouths do not have to be in the same vertical plane, but can be staggered fore and aft relative to each other. The horn mouths 154L and 154R are shown to be in the same rectilinear shape, and more specifically, rectangular in shape, having a width across the mouths that is greater in dimension than the height of the mouths. The dimensions of the width and height of the mouths are not directly related, and can be of other relative dimensions. Also, one or both of the width and height of the mouths can be selected based on a desired size of the throat "pinch" before the mouth flare 158; see FIG. 23.

Each horn 146L and 146R includes an elongate throat 160L and 160R extending between corresponding inlets 148L and 148R and mouths 154L and 154R. As shown in the figures, each of the throats 160L and 160R extends (curves) diagonally inwardly in the forward direction toward central plane 156, and also to be in alignment with the central axis 152 at mouths 154L and 154R. In addition, the throat 160R extends (rises upwardly) in a smooth, curved manner a distance equaling the elevation change from the elevation of inlet 148R to the higher elevation of outlet 154R. Correspondingly, throat 160L descends downwardly a distance corresponding to elevation change of inlet 148L to the elevation of mouth 154L. Throat 160L curves in a smooth arc to fold into a position beneath throat 160R. See FIGS. 22-29.

Drivers 142 are constructed with permanent magnets and coils in a known manner of high-frequency drivers. In the present situation, to achieve a lower vertical profile, the permanent magnets utilized in drivers 142 can be square in shape.

As shown in FIGS. 17, 18, 20, 21, 22, and 23, the horn flares 158 can be constructed as a unitary structure to project forwardly from the horn mouths 154L and 154R. Each of the horn flares 158 is substantially the same shape as the corresponding horn mouths, but flare outwardly in the horizontal direction from the horn mouths, thereby to enhance the horizontal projection of the sounds from the horn mouths. The horn flares 158 could be individually constructed rather than constructed as a unitary structure.

It will be appreciated that by the foregoing construction, the high-frequency horns are positioned within one-half of a wavelength of each other, thereby enabling control of the interaction between the sources. As a non-limiting example, the horn mouths may be 1.0 inch in height and on a 1.0 inch spacing. Moreover, the shape of the housing 120 causes the forwardly directed portion of the housing to function as a large horn for the high-frequency compression drivers and the mid-range transducers. Also the output from the high-frequency transducers 142 passes across the front of the horn wall 170 shown in FIGS. 18 and 19. In addition, as noted above, each of the high-frequency horns is independently powered by a separate transducer. Moreover, each of the high-frequency horns 144A, 144B is controlled by a separate DSP channel.

Although each of the horns 146L and 146R can be individually constructed and then assembled together, the above-described structure for the horn sets 144*a*-144*g* enables the horns to be constructed as consolidated subassemblies, for example, one subassembly at each side of the central plane 156. It is possible to produce the horn structure using permanent molds which are capable of achieving the rather complex shape of the horn structure very economically.

As shown in FIGS. 23-27, substantially planar flanges 162L and 162R extend vertically along the height of the horn structure at each of the inlets 40L and 40R of the horns 146L and 146R, respectively. The flanges 162L and 162R extend laterally outwardly from the inlets 148L and 148R, thereby to tie the inlet portions of the horns together and also to provide a mounting structure for drivers 142. Although the flanges 162L and 162R are shown as substantially planar, they can, of course, be in other shapes.

As noted above, a plurality of mid-range cone-type transducers 143 are mounted in a vertical array to each side of the horn structure 140. Although three mid-range cone transducers are illustrated in each vertical array, the number of such cone transducers can be increased or decreased from that illustrated. As shown in FIGS. 17, 18, 19, 20, and 21, the transducers 143 are protected in housings 136. Radial phase plugs 180 are used to load the transducers 143, extending the usable bandwidth thus facilitating the transition between mid-range and high-frequency transition. Moreover, the output from the transducers 143 passes through diamond-shaped openings 182 formed in the horn wall 170; see FIGS. 18 and 19, to also load the transducers. Horn flares 184 are disposed between the phase plugs 180 and the horn wall 170. The horn flares have forwardly directed openings 134, see also FIG. 5. The structure size and positioning of the mid-range cone transducers 143 enable the output therefrom to sum coherently with the high-frequency wave front generated by the high-frequency compression drivers 142 and helps maintain the desired wave front pattern control while providing horizontal symmetry. In this regard, the mid-range transducers present minimal impact on the high-frequency wave front, allowing the mid-range and high-frequency pass band origins to co-exist in nearly the same point in space without mutual interference.

Each of the mid-range transducers 143 is independently powered and controlled by a separate DSP channel. Thus, each of the mid-range transducers is independently powered and processed, as are each of the high-frequency compression drivers 143 and low-frequency cone transducers 130.

As shown in FIG. 5, a low-frequency cone transducer 130 is positioned in each of the lobe sections 122 of the housing 120. The low-frequency cone transducers occupy the entire height and width available in the lobe portion of the speaker. As shown in FIGS. 1, 2, 5, 9, 11, and 12, vertically spaced-apart slots 190 are located in the forward outward portion of the lobes 122 to provide enclosure venting for enhanced performance of the low-frequency transducers 130. In addition, vertically spaced slotted vents 192 are also provided in the forward inward portion of the lobe sections 122 to provide a degree of loading on the low-frequency cone transducers, and thereby shifting the apparent low-frequency sound source further apart and extending horizontal pattern control, thereby minimizing the build-up of low-frequency sound energy. These apertures 192, as well as apertures 190, extend outwardly beyond the transducers 130. This not only extends the uninterrupted surface of the horn, but also pushes the apparent origin of the low-frequency sound sources further apart. The net result is a configuration that provides optimal and consistent horizontal directivity for the size of the speaker housing. Also, the effective low-frequency cone transducers spacing is equal to approximately 90 percent of the mid-frequency horn size (the spacing between the inside surfaces of the lobes 122 of housing 120) with the horizontal beam width of the low-frequency transducers matched through crossover. In this regard, see U.S. Pat. No. 6,118,883, incorporated herein by reference.

With respect to additional features of the speakers 100, as shown in FIGS. 6 and 10-12, easy access manually graspable handles 196 curve around the rear corners of the housing 120 for convenient gripping, for example, when desired to lift or carry the speakers 100. Hand/finger wells 198 are recessed into the rear corner portions of the speaker housing 120. Because the rear portion of the speaker is much heavier than the forward portion of the speaker, placing the handles 196 in the rear locations, as shown, enables the speaker to be carried in a weight-balanced manner.

Referring additionally to FIG. 29, each of the speakers 100 includes four infrared proximity sensors (transmitters/receivers) 200 located at the sides of the housings 120 at the top and bottom thereof. In this regard, see FIGS. 1, 2, 6, 7, 8, 10, 11, and 12. These infrared sensors enable each of the speaker cabinets to communicate with adjacent cabinets, thereby to determine their relative positions within an array. Consequently, an array of speakers 100 can be fully modeled in software to match the array's physical configuration. Other types of proximity sensors can be used in place of infrared sensors, such as ultrasonic or radar based sensors.

Each of the loudspeakers 100 further includes a test key 201 that queries the loudspeaker for the last known status of the loudspeaker internal electronics. See FIGS. 6 and 10. The test key 201 is located on the control panel 206 at the rear 124 of the housing 120. This test key 201 is primarily intended for use during set-up of loudspeakers at the venue in question. The test key confirms the loudspeaker status based on the most recently performed self-diagnostic. When the test key is depressed, the internal systems of the speaker check the most recent test logs that are held in the speaker's memory. If the system finds no faults (acoustical or electronic), an indicator light 202 adjacent the test key will glow for a fixed time period. However, if the test function finds a fault within the speaker, the light will glow in a different color, indicating that a fault exists. The test key function is powered by a battery internal to the loudspeaker, and thus this particular test can be performed at any time, whether or not the speaker is externally powered or networked with other speakers and connected to the speaker control system 260, described below.

Figure 9:
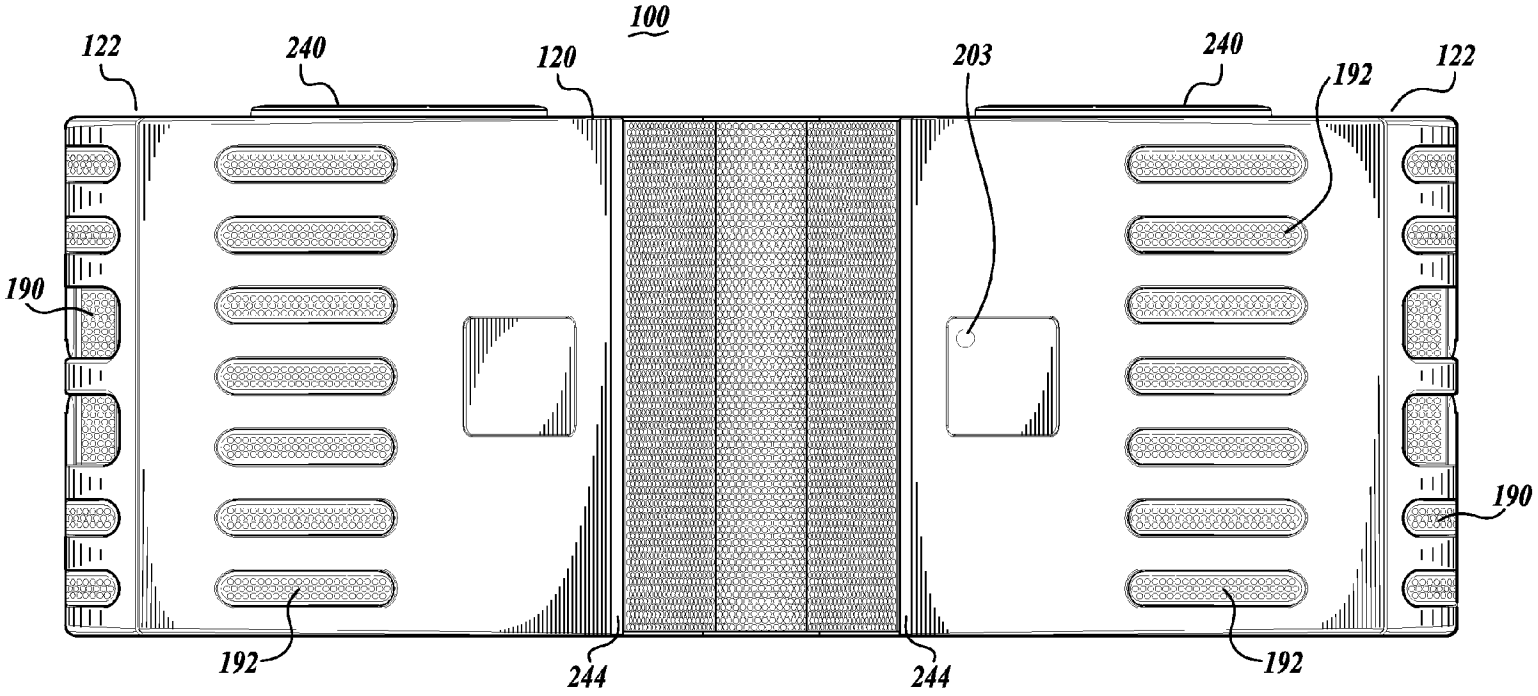
FIG. 9 is a front elevational view of FIG. 1.
Figure 10:
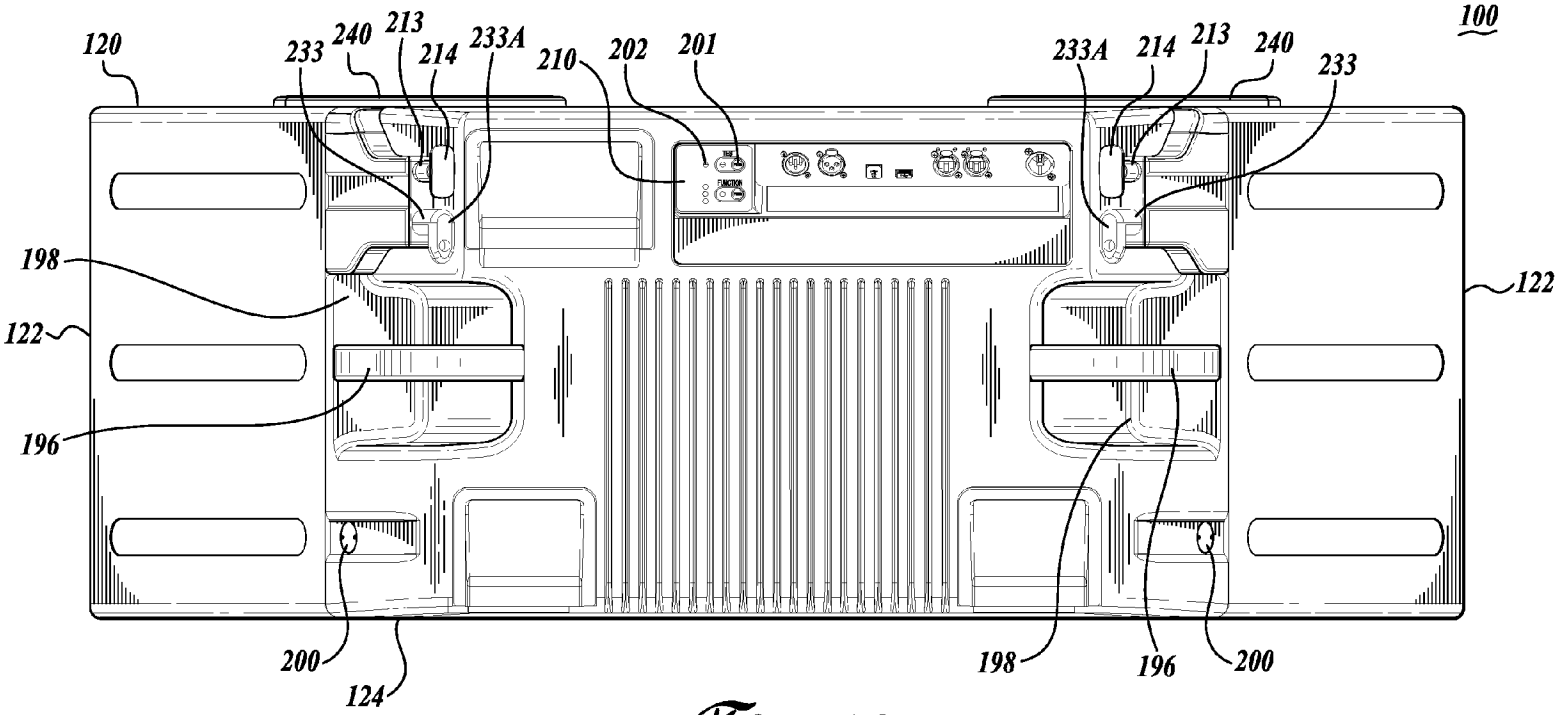
FIG. 10 is a rear elevational view of FIG. 1.
Figure 11:
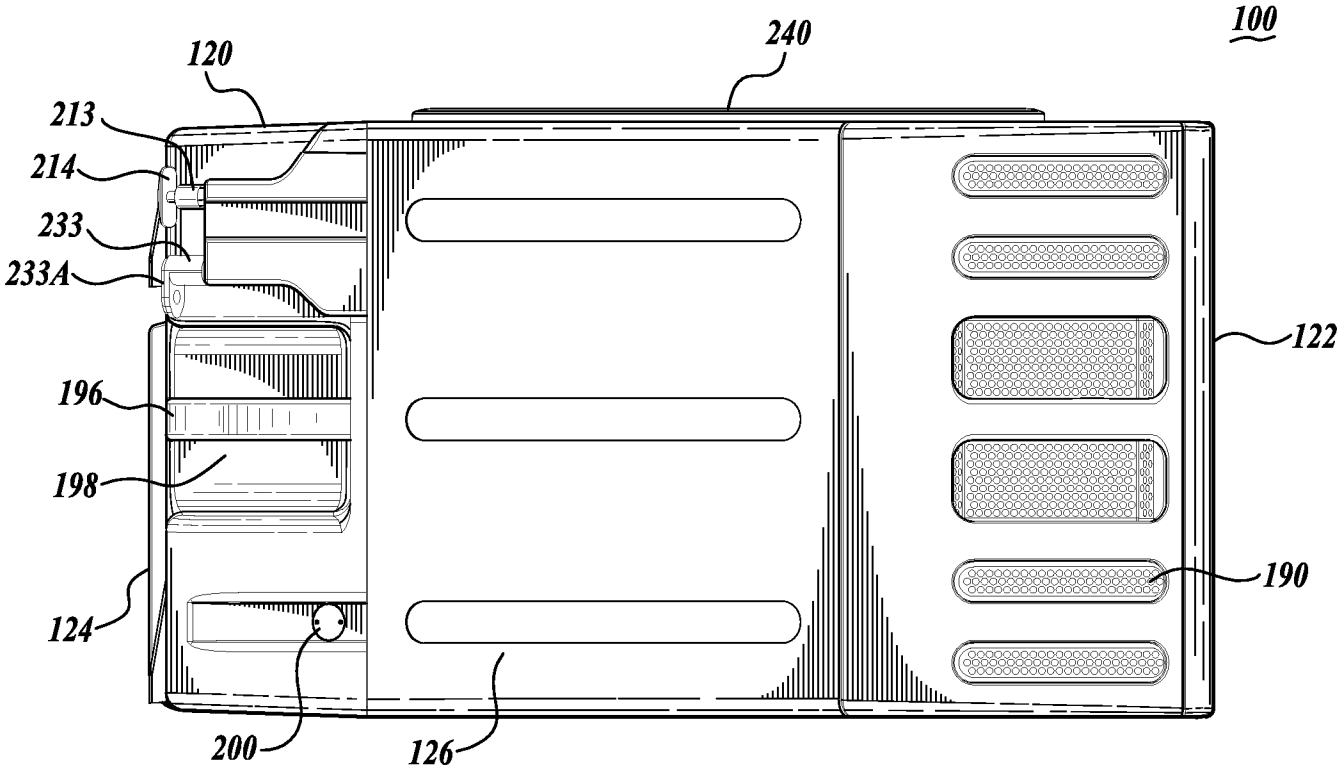
FIG. 11 is a side elevational view of FIG. 1 taken from the left side thereof.
Figure 12:
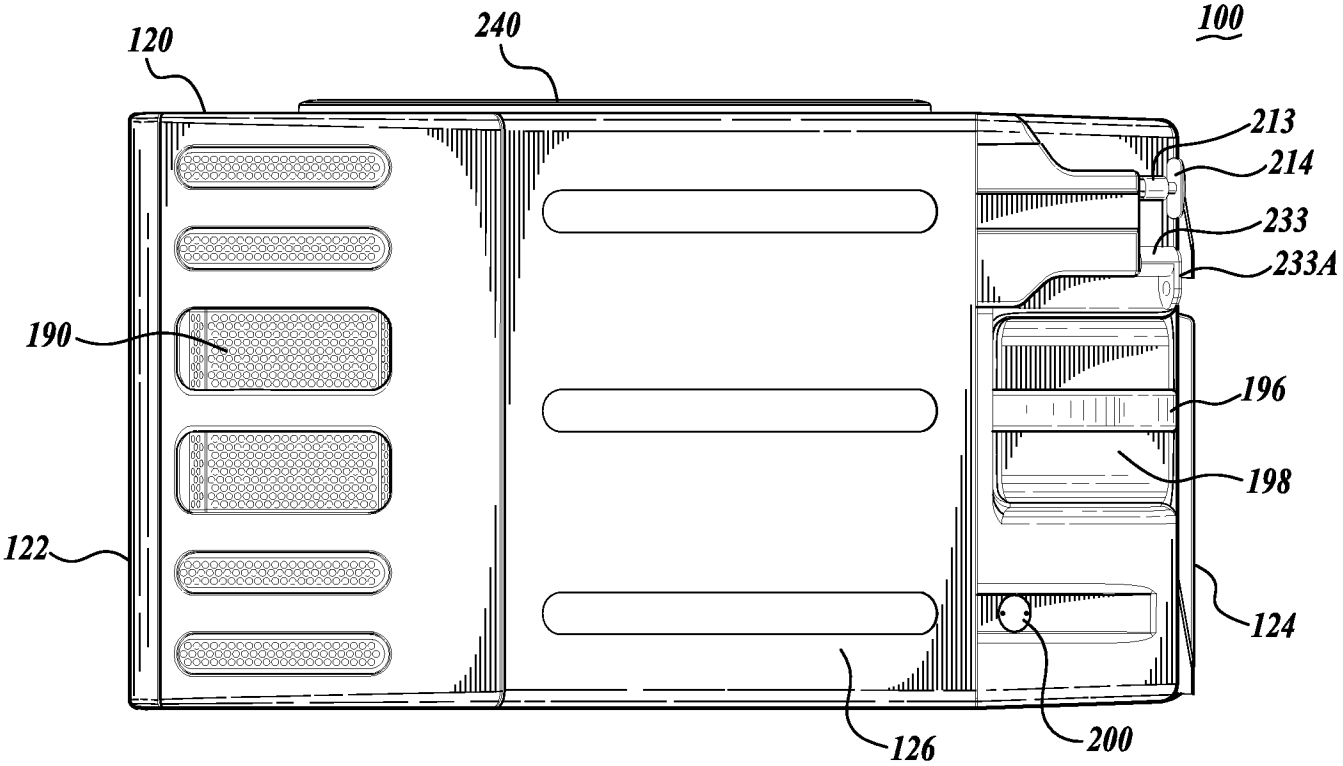
FIG. 12 is a side elevational view of FIG. 1 taken from the right side thereof.

Also, each speaker 100 includes a built-in microphone 203 to perform in-situ diagnostics of the speaker, see FIG. 9. Such diagnostics utilize stored reference curves for the speaker to verify the status of the speaker drivers and transducers. This is intended primarily as a shop function to identify or assist in troubleshooting faults. The acoustic measurement function is activated by a software, and is not intended to be used during events.

To describe the foregoing more specifically, the front right panel of each housing 120 houses a calibrated microphone 203 that is used to confirm the operation of each driver and transducer within a loudspeaker 100, see FIG. 9. At the time of manufacture, the frequency response of each transducer is measured by the front panel microphone and then stored in the speakers' non-volatile memory. When physical diagnostics is performed (for example, in the shop after a performance), the frequency response for each driver/transducer is measured and compared to the factory-stored response. If the two measurements vary significantly, the control system 260 provides an alert and recommends a corrective action, for example, driver repair or replacement. If it is necessary to replace the driver or transducers, the measured response for the new component is compared to that of the original component at the time of manufacture. If the new component is within the specifications of the original component, the new response is stored in the non-volatile memory of the speaker in place of the factory-measured response, and on a going-forward basis is used for comparison in future diagnostics. In this manner, it is possible to objectively verify the performance of each driver/transducer in loudspeaker 100.

As a further feature, each of the speakers 100 includes a built-in tilt sensor located within the interior of the speaker. This sensor can help establish the hang angle of the speaker array, which should be substantially vertical. The tile sensors provide active feedback to the control system 260 of the speaker, described below.

The speakers 100 can be vertically flown (hung) as shown in FIGS. 3, 4, and 13-15 through the use of flybar latches 210 that fit vertically through slots or rigging channels 212 formed in pairs along each outer side of housing 120. The flybar latches extend through the rigging channels 212 of the top speakers 100. Locking pin actuators 213 are provided interior to and along the sides 126 and 128 of the speaker to engage the flybar latches 210. These locking pin actuators 213 are activated by exterior rigging pin grips 214 that project rearwardly from each side of the speaker housing 120. The locking pins engage through latch-holes 215 formed in the lower end of the flybar latches.

The upper ends of the flybar latches are attachable to a flybar structure 216 composed of a pair of parallel transverse rearward and forward crossbars 220 and 222 having their corresponding ends connected by side bars 224 and 226 that extend along the outer face of the sides 126 and 128 of the speaker housing. It will be appreciated that the crossbars 220 and 222 can be connected to the side bars 224 and 226 by using brackets 227 or other means. Alternatively, the entire flybar can be constructed from a singularly welded, cast, or molded unit.

The construction of the flybar assembly 216 enables vertical speaker arrays to be conveniently jointed together in side-by-side relationship together by placing the corresponding side bars 224 and 226 of adjacent vertical arrays in face-to-face relationship to each other and then securing the corresponding side bars together. In this regard, two adjacent arrays may be initially positioned together through the use of a pin 228 extending outwardly from the forward and rearward portion of side bar 226. The pin 228 has an enlarged and pointed head 229, to initially engage through a rearward enlarged portion of a slot 230 formed in the side bar 224. Once the head 229 of pin 228 has extended through the enlarged width portion of the slot 230, the pin can be slid forwardly in the slot 230 to engage a narrower portion 231 of the slot that corresponds substantially to the width or diameter of the pin 228. When the pin 228 is in such position, the side bars 224 and 226 are in substantially a face-to-face position with each other.

Speakers 100 are conveniently attachable one on top of the other. In this regard, each of the speakers 100 includes rigging latches 232 slidably engageable within slots or rigging channels 212 at the sides of the speaker housings, see FIG. 2. Speakers 100 are attached in stacked relationship by releasing the rigging latches 232 of an upper speaker to engage within the channels 212 of a lower speaker and then the rigging latches 232 are locked in place within the channels 212 of the lower speaker. When one speaker is positioned above the other, the vertically slidable rigging latches 232 are released by retracting lower latching pins 233 by pulling a pin grip 233A outwardly, thereby to disengage the latching pin from through holes formed in the upper end portions of the rigging latch 232. At the time that the rigging latches 232 are released from the upper speaker 100, the upper latching pins 213 of the lower speaker are disposed in retracted or outward position by manipulating the rigging pin grip 214 thereof. Once the rigging latches 232 have slid downwardly into the channels 212 of the lower speaker, then the upper latching pins 213 are engaged through the engagement rigging latch holes 234 extending through the lower ends of the rigging latches 232, thereby to lock the rigging latches 232 with the lower speaker 100. The rigging latches 232 are only allowed to extend downwardly below the lower surface of the upper speaker a distance sufficient for the latching pins 213 to engage through the rigging latch holes 234. In this manner, the speakers 100 can be quickly and conveniently coupled together in a secure manner without requiring any tools. It will be appreciated that by the foregoing construction, the speakers 100 can be arranged in vertical arrays of any desired height. Also, the components for coupling speakers 100 are "built-in" within the envelope of the speaker housing, which facilitates attaching two or more vertical speaker arrays side-by-side to each other.

Moreover, since the speakers 100 are flown in vertical relationship to each other, there is no need to position adjacent speakers at an angle relative to the horizontal relative to each other or adjust any angularity between speakers. This greatly simplifies the flying of speaker arrays in terms of required rigging as well as rigging time. As such, the foregoing system for attaching vertically adjacent speakers may be utilized.

Referring to FIGS. 1, 2, and 5-7, arcuate-shaped stacking pads 240 are positioned on the top of each lobe section 122. The size and shape of the stacking pads 240 matches grooves 242 formed in the underside of the housing lobe sections 122; see FIG. 8. In this manner, the pads 240 locate vertically adjacent speakers one to another and assist in maintaining the speakers stationary relative to each other in the horizontal directions.

A vertical alignment line 244 extends vertically along the inside surfaces of each lobe section 122 adjacent grill 246, which covers the central portion of the front of the speaker. The alignment line 244 can serve as a visual indication of whether or not the speakers 100 of a vertical array are all in alignment with each other. As shown in FIGS. 3 and 4, when the speakers are in alignment, the alignment line 244 of the speakers form a continuous uniform, vertical line along the height of the array. The alignment line 244 can be of a color distinctive from the adjacent portion of the speaker housing so as to improve the visibility of the alignment line.

Figure 30:
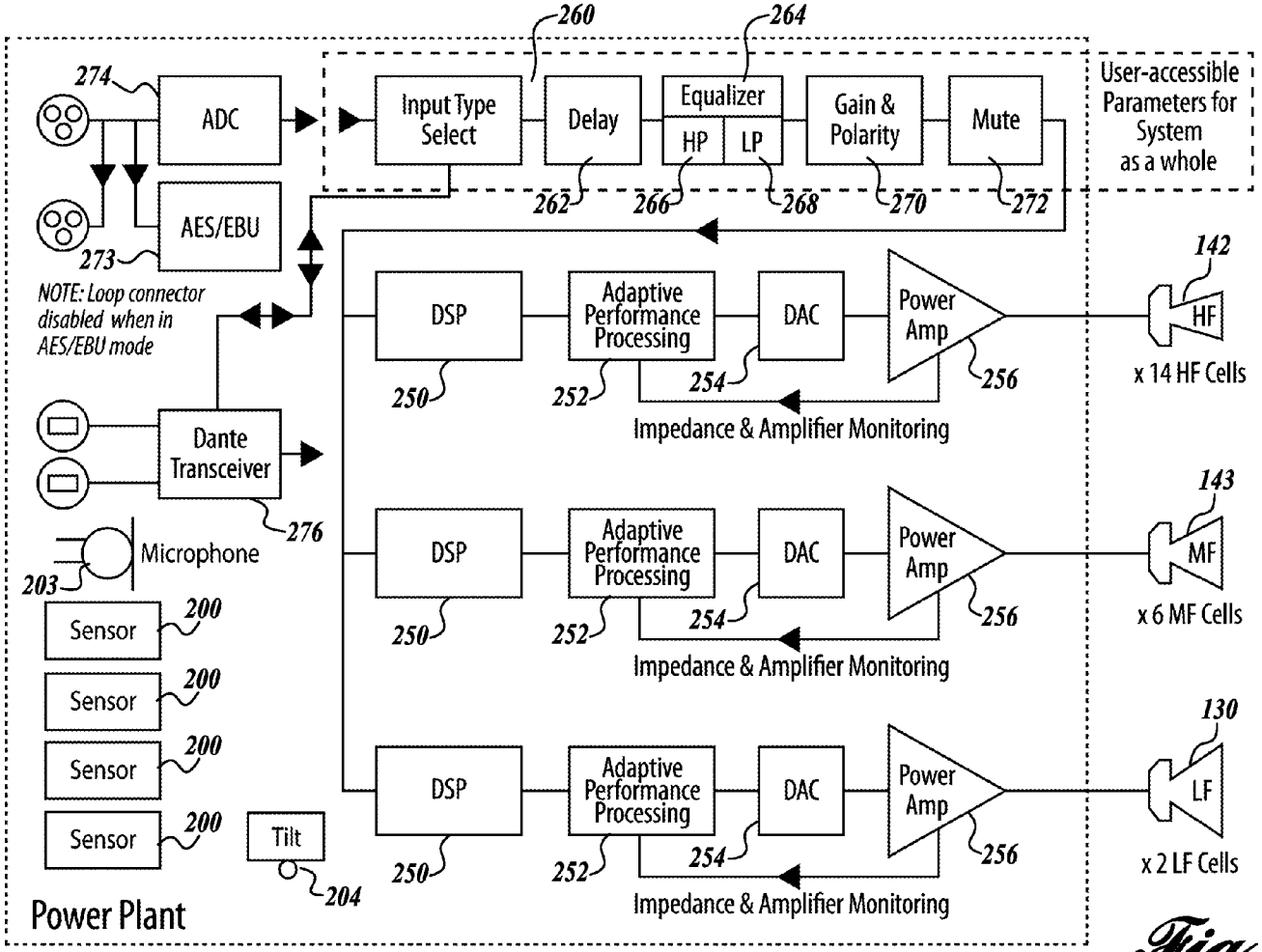
FIG. 30 is a schematic of a control system of the present disclosure.

As noted above, each of the high-frequency compression drivers 142 as well as each of the mid-range cone transducers 143 and each of the low-frequency cone transducers 130 is individually powered as well as individually controlled. This is schematically illustrated in FIG. 30. As shown in FIG. 30, associated with each high-frequency compression driver 142 and each mid and low-frequency cone transducer 143, 130 is a digital signal processor (DSP) 250 channel that operates in conjunction with adaptive performance software 252. This software assists in generating optimal DSP control parameters for the compression drivers 142 and cone transducers 143 and 130 by generating particular acoustic lobe configurations. The control signal from the DSP 250 is routed through a digital-to-analog converter 254 and then through a power amplifier 256, and then to the high-frequency, mid-range, and low-frequency compression drivers/cone transducers.

The adaptive performance software, by generating desired or optimal DSP control parameters for the compression drivers and cone transducers, is able to steer or direct the output from the compression drivers and cone transducers in the vertical and horizontal directions. Typically, the signal from the high-frequency compression drivers and mid and low-frequency cone transducers can be directed between any angle or angle range in the vertical direction from essentially straight down to straight up and anywhere therebetween. Moreover, the angular output in the horizontal direction of the compression drivers and cone transducers can be directed in about a 60° range.

Further, as shown in FIG. 30, a control system 260 is provided that is capable of controlling the gain, delay, and response of speaker systems. The control system 260 has a delay subsystem 262 for controlling the delay of the system. The control system 260 also has a parametric equalizer 264 as well as a high pass filter 266 and a low pass filter 268 to control the output produced by the system. The control system 260 further includes a subsystem 270 to alter the gain and polarity of the output from the system. In addition, the control system 260 has the ability to mute the output from the system via subsection 272.

Input of digital audio signals to the control system 260 can be via AES/EBU (AES3) port 273 routed through an analog-to-digital converter 274. The input to the controller 260, as well as output therefrom, also may be routed through Dante enabled ports 276. The Dante ports also function as the network interface to the control system 260.

Figure 31:
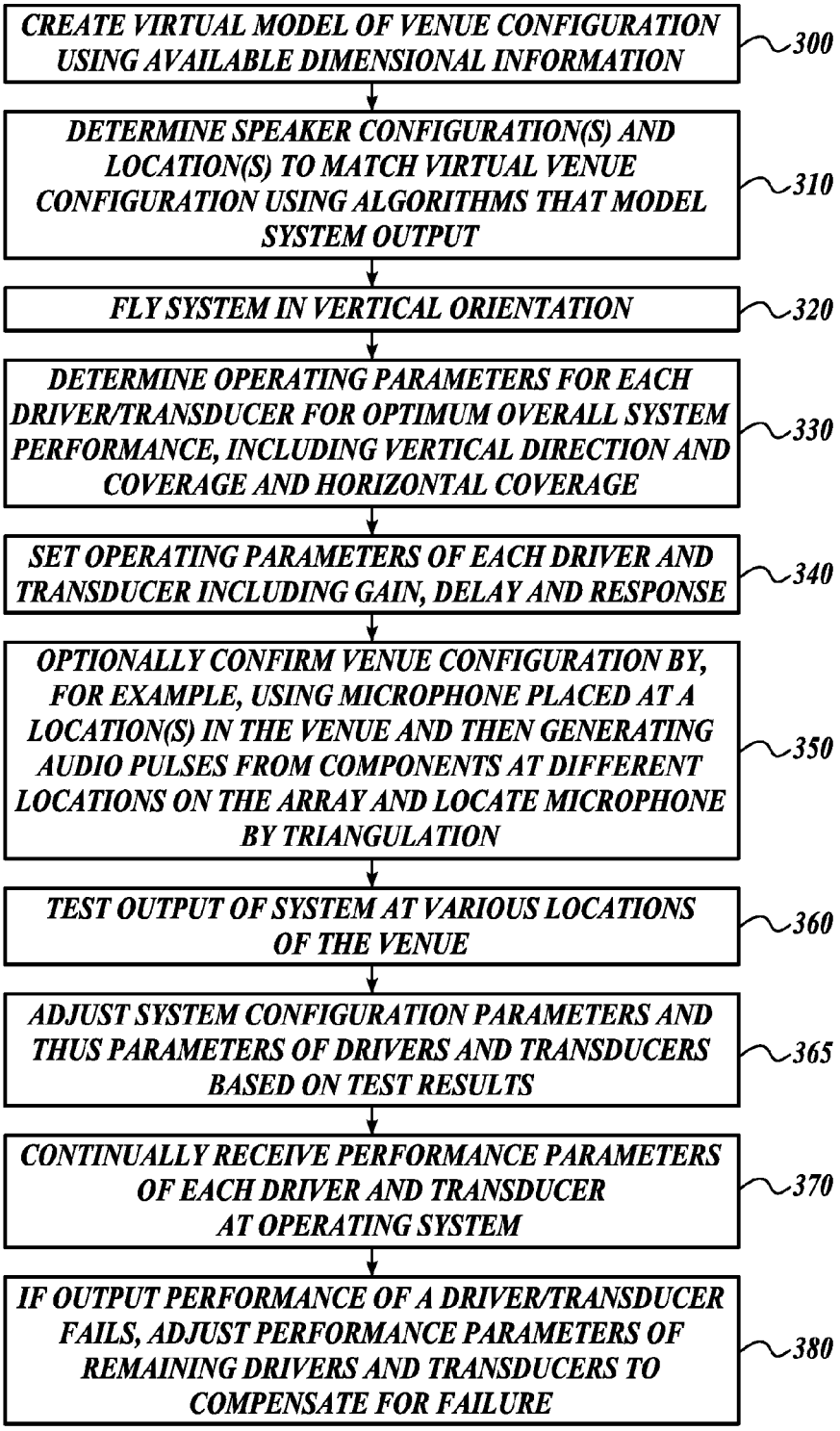
FIG. 31 is a flow diagram of the installation and operation of an audio system of the present disclosure.

One example of a methodology of installing arrays composed of speakers 100, such as speaker arrays 102, 104, 106, 108, or 110 is illustrated in FIG. 31. The exemplary methodology at step 300 includes first creating a definition of the venue, then, at step 310, determining the array or arrays of speakers 100 to match the venue. In this regard, the array coverage pattern is optimized to the venue based in part on the calculated ideal wave front. The arrays are flown at step 320, and then at steps 330 and 340 each of the drivers/transducers of each speaker is electronically adjusted and tuned to the venue. In this regard, the operational parameters of the speakers are determined and then set. The output of the system can be tested at various locations of the venue at step 360 and if needed, the output of the speaker and its components can be adjusted at step 365. Also during the use of the speakers, the output of each driver/transducer in each speaker is continuously monitored, and, if need be, adjustments made thereto, see steps 370 and 380.

The definition of the performance venue is "drawn" in software using dimensional information available pertaining to the venue, including its length, width, seating areas, stage elevation and position and size, balcony locations and positions, etc. Once the loudspeaker arrays have been flown in the venue, the venue configuration can be confirmed by using one or more microphones positioned at one or more points in the venue, see step 350. The audio system of the present disclosure generates several impulses from the high-frequency compression drivers and/or mid/low-frequency cone transducers at different plural locations. The system of the present disclosure trilaterates the location of the microphone. This information assists in modifying a preference or making corrections to the venue model. It will be appreciated that by using this trilateration function, it is no longer necessary to make manual measurements of the venue and carry out the associated numeric data entry of such measurements.

In step 310, noted above, one or more loudspeaker arrays are configured to match the venue in question, including matching the size and the shape of the venue, as well as the locations of the audience members and based on the ideal wave front for the venue. In this regard, algorithms have been developed to model the output of the loudspeakers 100 and each compression driver/cone transducer thereof not only to provide sound to all desired areas of a venue, but also to achieve pleasing results. In one approach the venue is divided into a grid of spots and the loudspeakers are armed to direct sound to each such spot. The loudspeaker arrays are constructed from identical speakers 100 and the rigging system, described above, is used to quickly and conveniently construct and position the arrays at the venue.

At steps 320 and 330, the operating parameters for each of the high-frequency compression drivers as well as the mid- and low-frequency cone transducers of each loudspeaker are determined to optimize the speakers to the venue. In this regard, as discussed above, each such compression driver and cone transducer is independently powered and processed. In part of the present process, the control system of the present disclosure is aware of the location of each of the speakers 100. As discussed above, four infrared or other type of proximity transceivers 200 are mounted on each speaker housing 120. The transceivers are located two at the top and two at the bottom of the speaker housing on opposite sides of the speaker housing, which enables the speakers to be modeled as two-dimensional arrays. With this information, the physical layout of the loudspeakers is determined. The data transmission that occurs between each loudspeaker identifies each adjacent loudspeaker. In this manner, the position of each loudspeaker is determined. Also, as noted above, each loudspeaker includes a tilt sensor 204 to confirm that the loudspeaker in question is vertical positioned, or whether the loudspeaker is at an angle off vertical. This information is also useful in adjusting or targeting the output from each speaker.

Using the control system 260, described above, the vertical directional output of each high-frequency compression driver and each mid-range and low-frequency cone transducer can be steered in the vertical direction to achieve the best audience coverage. In this regard, as noted above, the vertical angle directional output with the drivers and transducers is adaptive throughout the entire 180° range of from vertically down to vertically up. It will be appreciated that the spacing between each of the high-frequency compression drivers, as well as each of the speakers, is minimized so as to maximize the vertical lobe alteration within the speakers' operational bandwidth, and thereby minimize vertical artifacts.

Also, as noted above, the output of the transducers and drivers is controlled to provide the device horizontal coverage. The spacing between each horizontally adjacent transducer is also minimal, to maximize horizontal lobe alteration within that transducer's operational bandwidth, and to minimize horizontal artifacts. The nominal horizontal beam width of speakers 100 is approximately 70 degrees. This beam width can be increased up to 360 degrees by using multiple columns of speakers 100.

It will be appreciated that each of the speakers 100 within an array is networked together, and thus the controls for each of the compression drivers and cone transducers of each speaker, via a computer processor which operates a DSP as well as applicable algorithms to control the output and directionality of each of the transducers in each of the speakers. Such computer processor calculates all of the lobe formation parameters for the speakers and communicates them to the loudspeakers.

The networked control system also monitors the operation and performance of all of the loudspeaker compression drivers and cone transducers in the arrays on an ongoing basis, see step 370. Since the performance parameters for the loudspeaker components are sent electronically to the loudspeaker components from the control system, such parameters can be modified very quickly at any time. Some of the monitored parameters include transducer impedance, amplifier temperature, voltage, and currents of each driver/transducer, and this information is recorded on a "live" status log that can be downloaded. In this regard, not only is the functionality of each compression driver and cone transducer confirmed, but also the control system assesses the complete performance of each compression driver/cone transducer by comparing such performance with reference parameters stored in memory. Also, follow up or supplementary venue measurements can be conducted at any time, as discussed above, thereby to more accurately define the venue. For example, if additional seats in the venue are sold, or the performers are not satisfied with the sound quality, the coverage from the speakers can be easily modified.

The above methodology can be used to design the speaker configurations for the venues shown in FIGS. 13, 14, and 15. The nature of the "coverage" achieved at the venue is shown in FIGS. 13-15, wherein the various cross-batching corresponds to the sound level achieved at the various locations of the depicted venue.

FIG. 13 is a large indoor arena having multiple levels. Two substantial columns of speakers are used to cover the disparate requirements of the venue. Each of the arrays covers 120 horizontal degrees, but with varying the vertical directivity from column-to-column. Nonetheless, the arrays deliver the audio at the venue as a single integrated entity.

In FIG. 14, two speaker arrays are utilized to cover a very large, steeply raked outdoor amphitheater. The speakers are capable of delivering audio over the entire amphitheater within +/−2 decibels. The vertical directivity of the speakers is directed upwardly sufficiently to reach the back of the amphitheater while spilling off the lower forward section of the amphitheater.

FIG. 15 depicts a large tent utilizing two arrays composed of a six-module main column which covers most of the area and is pointed to the unit's far corner on two-module outer column that fills the immediate near-field and house-left.

If a failure of one or more transducers, or even an entire speaker, occurs after the speaker arrays are flown, or even during a performance, the failure is recognized by the networked control system and corrective action can be taken, step 380. Even before the overall system monitoring occurs, each loudspeaker can be tested, since each loudspeaker contains a self-test function built into the circuitry of the loudspeaker system to enable verification that all the components of the loudspeaker are operating correctly. The results of this test can be queried by simply pressing a self-test button on the loudspeaker.

If a portion of the system is damaged, the control system will determine a solution and adjust the system coverage in response. Essentially, the control system is able to rebuild the acoustical model of the loudspeaker components without the "failed" sources. In this regard, compression drivers and cone transducers parameters can be adjusted to affect the vertical direction between adjacent speakers and direct sound at every "spot" in the venue. Therefore, "spots" to be hit are redefined to adjust to the non-functioning drivers/transducers. If a particular loudspeaker or component thereof cannot "hit" every desired spot in the venue, then adjacent loudspeakers, drivers, and/or transducers are used to "fill in" the sound to achieve the desired coverage. Due to the reduction in sound level over distance, typically, more loudspeaker components are focused at further areas, and fewer loudspeaker components are directed at closer areas. It is not necessary to physically alter speaker-to-speaker angles, but instead digital signal processing is used to alter the component-to-component angles in accordance with the new virtual acoustical model created with the failed source(s) removed. The same process is used to achieve the desired horizontal coverage in the instance that a failure occurs in one or more of the drivers/transducers, or even in an entire speaker.

The speaker 100 and the arrays constructed therewith as well as the control system for the arrays described above provide significant advantages over preexisting loudspeaker arrays. For example, in the arrays of the present disclosure, the position of each loudspeaker itself is self-recognizing, and all of the drivers/transducers in each loudspeaker are networked together and individually powered and controlled for output level as well as for horizontal and vertical directionality. Further, the present loudspeaker system is "self-healing" and adapts if one or more component failures occur, even during use. Further, the rigging of the loudspeaker arrays is simplified and thus the arrays can be flown quickly and easily and also disassembled quickly and easily.

While exemplary embodiments of the present disclosure have been illustrated and described, it will be appreciated that various changes can be made therein without departing from the spirit and scope of the invention. For example, although loudspeaker 100 is illustrated and described herein as composed of 14 high-frequency transducers, six mid-range transducers and two low-frequency transducers, the number of high-frequency, mid-range and low-frequency transducers can be altered or modified. Regardless of the numbers of the various transducers used, what is of significance is the close and relative arrangement of the transducers and drivers, the manner of their loading using horns, horn walls, horn flairs, phase plugs, and other structures, and that they are each individually controlled.

It will be appreciated that loudspeaker 100 and the various arrays that may be constructed therefrom provide significant advances and advantages. For example, each of the loudspeakers of the array can be of identical construction, thereby minimizing the need for spare components or parts. The loudspeakers are arrayed in a vertical arrangement, and are "dead hung," thereby simplifying the flying of the arrays. In this regard, there are no vertical splay angles to adjust. Further, by the selection of the number of transducers and horns, their size and their spacing and relative location, the speakers 100 create a radial coverage pattern that is very narrowly focused.

Further, as described above, the tuning of the drivers and transducers of the loudspeakers is carried out electronically, and thus the parameters for the transducers and drivers can be conveniently and rapidly specified, as well as adjusted. This also enables the drivers and transducers in speaker 100 to adjust if any of the drivers and transducers fail during use. Further, the speakers 100 enable the arrays to be precisely configured to a particular venue and also enable the system to be scaleable to a particular venue.

Moreover, by the construction and control of loudspeaker 100, loudspeaker 100 and the arrays composed thereof enable the loudspeaker and arrays to produce a continuous and consistent beam width versus frequency characteristic over the entire working frequency range of a loudspeaker. Further, the loudspeaker 100 and the arrays composed thereof exhibit continuous and consistent directional pattern characteristics versus frequency output from the loudspeaker, while occupying a relatively small amount of physical space, especially for the level of output generated by the loudspeaker.

The embodiments of the invention in which an exclusive property or privilege is claimed are defined as follows:

1. An adaptive loudspeaker system adaptive to a venue at which the loudspeaker system is in use, comprising:

(a) a plurality of adaptive loudspeakers, each loudspeaker comprising:

(i) a housing;

(ii) a plurality of transducers within the housing, said transducers being independently powered and independently controlled relative to each other; and (iii) a digital signal processor channel for each transducer to control at least one of the vertical and horizontal directionality of the loudspeaker system output;

(b) an electronic network interconnecting the digital signal processor channels with each other; and (c) a control system monitoring and controlling the operation and performance of the transducers individually, said control system comprising a computer processor connected to said electronic network and functions to automatically calculate optimal loudspeaker output acoustic lobe formation parameters based on an electronically modeled geometric configuration of the venue, said control system controlling the operation of the transducers based in part on the calculated loudspeaker output acoustic output lobe formation parameters;

said control system continuously monitoring the system condition of each transducer in each loudspeaker and adjusting the system parameters as necessary, such system parameters comprising transducer impedance, amplifier temperature, transducer voltage, and transducer current.

2. The adaptive loudspeaker system according to claim 1, wherein said control system controls said digital signal processor channel to direct the acoustical output from said loudspeakers in a desired direction selected from the group consisting of a vertical direction, a horizontal direction and both vertical and horizontal directions.

3. The adaptive loudspeaker system according to claim 1, wherein said control system controls at least one of the gain, delay, and response of each transducer in the loudspeaker, thereby to selectively direct the acoustical output from the loudspeaker in a desired vertical direction to achieve a desired coverage of the venue in which the loudspeaker is located.

4. An adaptive loudspeaker system, comprising:

(a) a plurality of adaptive loudspeakers, each loudspeaker comprising:

(i) a housing;

(ii) a plurality of transducers within the housing, said transducers being powered independently and controlled independently of each other;

(iii) a digital signal processor channel for each transducer to control at least one of the vertical and horizontal directionality of the loudspeaker system output; and (iv) a self-testing program incorporated into the circuitry of the loudspeaker, said self-test program operable to verify that the transducers of the loudspeaker are operating properly;

(b) an electronic network interconnecting the digital signal processor channels with each other;

(c) a control system monitoring and controlling the operation and performance of the transducers individually, said control system comprising a computer processor connected to said electronic network and capable of calculating the loudspeaker output acoustic lobe formation parameters, said control system controlling the operation of the transducers based in part on the calculated loudspeaker output acoustic output lobe formation parameters; and (d) the control system altering the operation of the remaining loudspeakers and transducers to adapt to the failure of a loudspeaker or to the failure of a transducer.

5. An adaptive loudspeaker system, comprising:

(a) a plurality of adaptive loudspeakers, each loudspeaker comprising:

(i) a housing;

(ii) a plurality of transducers within the housing, said transducers being powered and controlled independently of each other; and (iii) a digital signal processor channel for each transducer to control the vertical and horizontal directionality of the loudspeaker system output;

(b) an electronic network interconnecting the digital signal processor channels with each other; and (c) a control system monitoring and controlling the operation and performance of the transducers individually, said control system comprising a computer processor connected to said electronic network and capable of calculating the loudspeaker output acoustic lobe formation parameters, said control system controlling the operation of the transducers based in part on the calculated loudspeaker output acoustic output lobe formation parameters; and (d) wherein said control system functions to verify a specific location in a venue relative to each loudspeaker, said specific location corresponding to the location of a test microphone, said control system generating acoustical impulses from transducers positioned at different locations to trilaterally locate the microphone and thereby determine the distance and direction of the microphone relative to the transducers which generate the acoustical impulses.

6. The adaptive loudspeaker system according to claim 1, wherein said transducers comprise one or more transducers selected from the group consisting of:

high-frequency transducers in the range of about 1500 Hz to 20 kHz;

mid-frequency transducers in the range of about 200 Hz to 2 kHz; and low-frequency transducers in the range of about 30 Hz to 300 Hz.

7. The adaptive loudspeaker system according to claim 1, wherein said loudspeakers are stacked in one or more vertical arrays.

8. The adaptive loudspeaker system according to claim 1, further comprising a rigging system to arrange a plurality of loudspeakers in a stacked, substantially straight vertical line.

9. An adaptive loudspeaker system comprising:

(a) a plurality of adaptive loudspeakers operating in at least mid and high frequencies, each loudspeaker comprising:

(i) a housing;

(ii) a plurality of transducers operating in at least mid and high frequencies within the housing, said transducers being powered and controlled independently of each other; and (iii) a digital signal processor channel for each transducer to control at least one of the vertical and horizontal directionality of the loudspeaker system output;

(b) an electronic network interconnecting the digital signal processor channels with each other;

(c) a control system monitoring and controlling the operation and performance of the transducers individually, said control system comprising a computer processor connected to said electronic network and capable of calculating the loudspeaker output acoustic lobe formation parameters, said control system controlling the operation of the transducers based in part on the calculated loudspeaker output acoustic output lobe formation parameters; and (d) sensors selected from the group consisting of: (i) at least one proximity sensor disposed on the loudspeaker housing, said control system capable of determining the position of each housing based on the output signal from said at least one proximity sensor; and (ii) a tilt sensor associated with each loudspeaker, said control system capable of determining the tilt of each loudspeaker based on the output from each tilt sensor.

10. A method of providing sound to a venue, comprising:

(a) electronically creating a geometric model of the venue;

(b) assembling a plurality of loudspeakers in stacked relationship, and positioning the stacked loudspeakers so that the loudspeakers are disposed in a substantially vertical array, wherein each of said loudspeakers comprises a plurality of transducers, wherein each of the transducers is operated via digital signal processor channels and wherein each transducer is independently powered;

(c) based on the modeled venue configuration, positioning the stacked vertical array of loudspeakers at one or more locations relative to the venue;

(d) operating each of the transducers of the loudspeaker individually from each other via a control system that networks the digital signal processor channels together and also networks the speakers together;

(e) testing the output of each transducer;

(f) setting at least one of the gain, delay, and response of each transducer individually based on the geometric model of the venue to direct the sound emanating from the speaker array in selected direction selected from the group of a vertical and horizontal direction; and (g) continuously monitoring the system parameters of each transducer and each loudspeaker and adjusting the system parameters as necessary, said system parameters comprising transducer impedance, amplifier temperature, transducer voltage and transducer current.

11. The method of providing sound to a venue according to claim 10, wherein the loudspeakers utilized to assemble the vertical array of loudspeakers are each substantially identical to each other with respect to at least one of a high-frequency, mid-range, and low-frequency transducers positioned within each of the loudspeakers.

12. A method of providing sound to a venue, comprising:

(a) creating a model of the configuration of the venue;

(b) assembling a plurality of loudspeakers operating in at least mid and high frequencies in stacked relationship, and positioning the stacked loudspeakers so that the loudspeakers are disposed in a substantially vertical array, wherein each of said loudspeakers comprises transducers, wherein each of the transducers is independently powered and is independently operated via digital signal processor channels;

(c) based on the modeled venue configuration, positioning the stacked vertical array of loudspeakers at one or more locations relative to the venue;

(d) operating each of the transducers at at least mid and high frequencies of the loudspeaker individually from each other via a control system that networks the digital signal processor channels together and also networks the speakers together;

(e) testing the output of each transducer;

(f) setting at least one of the gain, delay, and response of each transducer individually to direct the sound emanating from the speaker array in selected vertical and horizontal directions; and (g) wherein the control system recognizes if a particular transducer is not operational, and adjusts the output of other operational transducers to compensate for the non-operational transducer.

13. The method of providing sound to a venue according to claim 10, further comprising providing the sound to an adjusted configuration of the venue by setting at least one of the gain, delay, and response of each transducer individually to direct the sound in at least one of the vertical and horizontal directions to the adjusted venue configuration.

14. A method of providing sound to a venue, comprising:

(a) creating a model of the configuration of the venue;

(b) assembling a plurality of loudspeakers operating in at least mid and high frequencies in stacked relationship, and positioning the stacked loudspeakers so that the loudspeakers are disposed in a substantially vertical array, wherein each of said loudspeakers comprises transducers, wherein each of the transducers is operated via an independent digital signal processor channel and each of the transducers is independently powered;

(c) based on the modeled venue configuration, positioning the stacked vertical array of loudspeakers at one or more locations relative to the venue;

(d) operating each of the transducers at at least mid and high frequencies of the loudspeaker individually from each other via a control system that networks the digital signal processor channels together and also networks the speakers together;

(e) testing the output of each transducer; and (f) setting at least one of the gain, delay, and response of each transducer individually to direct the sound emanating from the speaker array in selected vertical and horizontal directions;

(g) determining or confirming the configuration of the venue using trilateration techniques; and (h) using the determined or confirmed venue configuration to position the stacked vertical array of loudspeakers at one or more locations relative to the venue.

15. A loudspeaker, comprising:

(a) a housing;

(b) a plurality of transducers operating in at least mid and high frequencies within the housing;

(c) electronic circuitry operably connected to the transducers;

(d) a control system monitoring and controlling the operation and performance of the transducers independently of each other, said control system comprising a computer processor capable of calculating the loudspeaker output acoustic lobe formation parameters, said control system controlling the operation of the transducers based in part on the calculated loudspeaker output acoustic lobe formation parameters; and (e) a self-testing program incorporated into the circuitry of the loudspeaker, said self-test program operable to verify that the transducers of the loudspeaker are operating properly, the self-testing program testing at least one of the transducer impedance, transducer voltage and transducer current.

16. A loudspeaker, comprising:

(a) a housing;

(b) a plurality of transducers operating in at least mid and high frequencies within the housing, (c) a control system monitoring and controlling the operation and performance of the transducers at at least mid and high frequencies, said control system comprising a computer processor capable of calculating the loudspeaker output acoustic lobe formation parameters, said control system controlling the operation of the transducers based in part on the calculated loudspeaker output acoustic lobe formation parameters; and (d) wherein said control system functions to verify a specific location relative to each loudspeaker corresponding to the location of a test microphone, said control system generating acoustical impulses from transducers positioned at different locations to trilaterally locate the microphone and thereby determine the distance and direction of the microphone relative to said transducers which generate the acoustical impulses.

17. A loudspeaker, comprising:

(a) a housing;

(b) a plurality of transducers operating in at least mid and high frequencies within the housing;

(c) a control system monitoring and controlling the operation and performance of the transducers, said control system comprising a computer processor capable of calculating the loudspeaker output acoustic lobe formation parameters, said control system controlling the operation of the transducers based in part on the calculated loudspeaker output acoustic lobe formation parameters; and (d) at least one proximity sensor disposed on or in the loudspeaker housing, said control system capable of determining the position of the housing based on the output signal from said at least one proximity sensor.

18. A method of providing sound to a venue, comprising:

(a) creating a model of the configuration of the venue;

(b) assembling a plurality of loudspeakers operating in at least mid and high frequencies in stacked relationship, and positioning the stacked loudspeakers so that the loudspeakers are disposed in a substantially vertical array, wherein each of said loudspeakers comprises transducers, wherein the transducers are operated via digital signal processor channels;

(c) based on the venue configuration, positioning the stacked vertical array of loudspeakers at one or more locations relative to the venue;

(d) determining the location of each loudspeaker from signals generated by proximity sensors disposed on or in the housings of the loudspeakers; and (e) using the determined locations of the loudspeakers to adjust the operating parameters of the loudspeaker to direct the sound from the loudspeaker in the vertical and horizontal directions.

19. The method of providing sound to a venue according to claim 18, further comprising operating each of the transducers of the loudspeaker individually from each other via a control system that networks all the digital signal processor channels together and also networks all of the speakers together.

20. A method of providing sound to a venue, comprising:

(a) creating a model of the configuration of the venue;

(b) assembling a plurality of loudspeakers operating in at least mid and high frequencies in stacked relationship, and positioning the stacked loudspeakers so that the loudspeakers are disposed in a substantially vertical array, wherein each of said loudspeakers comprises transducers, wherein each of the transducers is operated via a control system utilizing digital signal processor channels;

(c) based on the venue configuration, positioning the stacked vertical array of loudspeakers at one or more locations relative to the venue; and (d) verifying at least one specific location in the venue relative to each loudspeaker, said at least one specific location corresponding to the location of a test microphone, said control system generating acoustical impulses from the transducers positioned at different locations to trilaterally locate the microphone and thereby determine the distance and direction of the microphone relative to the transducers which generate the acoustical impulses.

* * * * *